US011535477B2

(12) United States Patent
Wakabayashi et al.

(10) Patent No.: US 11,535,477 B2
(45) Date of Patent: Dec. 27, 2022

(54) MEDIUM PROCESSING DEVICE AND AUTOMATIC TRANSACTION DEVICE

(71) Applicant: Oki Electric Industry Co., Ltd., Tokyo (JP)

(72) Inventors: Madoka Wakabayashi, Tokyo (JP); Toshitaka Saitou, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 366 days.

(21) Appl. No.: 16/762,127

(22) PCT Filed: Oct. 24, 2018

(86) PCT No.: PCT/JP2018/039557
§ 371 (c)(1),
(2) Date: May 6, 2020

(87) PCT Pub. No.: WO2019/146191
PCT Pub. Date: Aug. 1, 2019

(65) Prior Publication Data

US 2020/0361737 A1 Nov. 19, 2020

(30) Foreign Application Priority Data

Jan. 26, 2018 (JP) ..... JP2018-011921

(51) Int. Cl.
*B65H 29/60* (2006.01)
*B65H 5/06* (2006.01)
(Continued)

(52) U.S. Cl.
CPC ..... *B65H 29/60* (2013.01); *B65H 5/06* (2013.01); *B65H 5/36* (2013.01); *B65H 29/14* (2013.01);
(Continued)

(58) Field of Classification Search
CPC . B65H 5/26; B65H 5/36; B65H 5/062; B65H 29/58; B65H 2404/632; B65H 2301/3124; G07D 11/18
See application file for complete search history.

(56) References Cited

U.S. PATENT DOCUMENTS 8,167,304 B2 * 5/2012 Fukazawa ..... B65H 29/58 271/225
8,628,081 B2 * 1/2014 Michels ..... B65H 29/58 902/15
(Continued)

FOREIGN PATENT DOCUMENTS

JP 2009249174 A 10/2009
JP 2010113499 A 5/2010
(Continued)

*Primary Examiner* — Patrick Cicchino
(74) *Attorney, Agent, or Firm* — Rabin & Berdo, P.C.

(57) ABSTRACT

A medium processing device includes a conveyance guide that forms first, second and third conveyance paths that intersect, a blade configured to be rotatable around a blade center point, and that switches a conveyance route of the medium by connecting any two of the three conveyance paths with each other, and a first pair, second pair and third pair of conveyance rollers that are rotatable and are configured to hand off the medium between two conveyance paths connected by the blade. The first pair of conveyance rollers includes a first roller and a second roller. The second roller is closer than the first roller to the third pair of conveyance rollers. A radius of the second roller is larger than a radius of the first roller. A first center holding distance is different from one or both of a second center holding distance and a third center holding distance.

9 Claims, 14 Drawing Sheets

(51) Int. Cl.

| | |
|---|---|
| ***B65H 5/36*** | (2006.01) |
| ***B65H 29/14*** | (2006.01) |
| ***G07D 11/18*** | (2019.01) |
| *G07D 11/50* | (2019.01) |
| *G07D 11/60* | (2019.01) |
| *G07D 11/14* | (2019.01) |

(52) U.S. Cl.
CPC ..... *G07D 11/18* (2019.01); *B65H 2301/3124* (2013.01); *B65H 2404/632* (2013.01); *B65H 2701/1912* (2013.01); *G07D 11/14* (2019.01); *G07D 11/50* (2019.01); *G07D 11/60* (2019.01); *G07D 2211/00* (2013.01)

(56) References Cited

U.S. PATENT DOCUMENTS

| | | | | |
|---|---|---|---|---|
| 10,621,808 | B1 * | 4/2020 | Anderson ..... | G07D 11/10 |
| 2010/0108576 | A1 | 5/2010 | Wada et al. | |
| 2010/0213661 | A1 * | 8/2010 | Fukazawa ..... | B65H 29/60 271/265.01 |
| 2018/0290849 | A1 | 10/2018 | Hosokawa et al. | |

FOREIGN PATENT DOCUMENTS

| | | | |
|---|---|---|---|
| JP | 2016098049 | A | 5/2016 |
| JP | 2016222409 | A | 12/2016 |
| JP | 2017124893 | A | 7/2017 |

* cited by examiner

MEDIUM PROCESSING DEVICE AND AUTOMATIC TRANSACTION DEVICE

TECHNICAL FIELD

The present disclosure relates to a medium processing device and an automatic transaction device, and is suitably applied to, for example, an automatic teller machine (ATM) that performs a desired transaction by inserting a sheet-shaped medium such as a banknote.

BACKGROUND ART

ATMs widely employed in financial institutions and the like allow a user to deposit cash in the form of banknotes or coins, or allow a user to withdraw cash, according to the content of transactions with the user (financial institution customers, etc.). ATM's include, for example, a banknote deposit/withdrawal device that performs processing relating a deposit/withdrawal of banknotes, a coin deposit/withdrawal device that performs processing relating a deposit/withdrawal of coins, or a passbook processing device that handles a passbook.

The banknote deposit/withdrawal device includes, for example, a customer interface that gives banknotes to a user and receives banknotes from a user, a conveyance section that conveys banknotes, a classification section that classifies the denomination, authenticity, and other characteristics of the inserted banknotes, a temporary holding section that temporarily holds the inserted banknotes, and banknote storage boxes that store banknotes. The conveyance section includes, for example, a conveyance guide that guides banknotes to advance along a conveyance route, a conveyance roller that transmits driving force to banknotes, and a switching unit that switches the conveyance route of banknotes.

Banknote deposit/withdrawal devices often utilize three-way switching units, which switch the conveyance route of banknotes in three ways by forming a conveyance route connecting any two of the three conveyance paths (see, for example, Japanese Patent Application Laid-Open (JP-A) No. 2009-249174 (FIG. 3)). A three-way switching unit is made up of, for example, a conveyance guide that forms three conveyance paths that intersect each other, a blade that is configured to change a posture by rotating, and that guides banknotes in a state where any two conveyance paths are connected to each other so as to guide the travel of the banknotes, and three pairs of conveyance rollers that hold banknotes conveyed on each conveyance path and transmit the driving force by a rotation.

SUMMARY OF THE INVENTION

Technical Problem

In a three-way switching unit, it is necessary to reliably hand off banknotes between a pair of conveyance rollers on an upstream side along a conveyance route and a pair of conveyance rollers on a downstream side of the conveyance route formed by connecting any two conveyance paths by a blade rotated to a predetermined posture.

Therefore, it is necessary for each pair of conveyance rollers to be relatively close such that a distance between the pair of conveyance rollers of the upstream side and the pair of conveyance rollers of the downstream side is shorter than a length of the banknote in a conveyance direction.

In the above design, the three-way switching unit needs to be treated as one relatively large part or unit, including the three pairs of conveyance rollers, and thereby there are various constraints on the arrangement and the relationship with surrounding parts. Therefore, the degree of freedom for design is low in a portion of the banknote deposit/withdrawal device related to the three-way switching unit, which may lead to an increase in the size of the device and an increase in the number of parts.

In consideration of the above circumstances, the present disclosure proposes a medium processing device and an automatic transaction device that can increase a degree of freedom for design while realizing switching of a conveyance route and handing off of a medium between pairs of conveyance rollers.

Solution to Problem

In order to address such issues, a medium processing device of the present disclosure includes a conveyance guide that forms first, second and third conveyance paths that intersect, and that guides a medium along each conveyance path, a blade configured to be rotatable around a predetermined blade center point, and that switches a conveyance route of the medium by connecting any two of the three conveyance paths, a first pair of conveyance rollers in the first conveyance path, the first pair of conveyance rollers including a first roller and a second roller facing the first roller across the first conveyance path, a second pair of conveyance rollers in the second conveyance path, the second pair of conveyance rollers including a third roller and a fourth roller facing the third roller across the second conveyance path, and a third pair of conveyance rollers in the third conveyance path, the third pair of conveyance rollers including a fifth roller and a sixth roller facing the fifth roller across the third conveyance path. The first, second, and third pairs of conveyance rollers are rotatable and are configured to hand off the medium between two conveyance paths connected by the blade. The second roller is closer than the first roller to the third pair of conveyance rollers. The fourth roller is closer than the third roller to the third pair of conveyance rollers. A radius of the second roller is larger than a radius of the first roller. A first holding point is a point between the first roller and the second roller where the first pair of conveyance rollers holds the medium. A second holding point is a point between the third roller and the fourth roller where the second pair of conveyance rollers holds the medium. A third holding point is a point between the fifth roller and the sixth roller where the third pair of conveyance rollers holds the medium. A distance from the blade center point to the first holding point defines a first center holding distance. A distance from the blade center point to the second holding point defines a second center holding distance. A distance from the blade center point to the third holding point defines a third center holding distance. The first center holding distance is different from one or both of the second center holding distance and the third center holding distance.

A medium processing device of the present disclosure includes a conveyance guide that forms first, second and third conveyance paths that intersect, and that guides a medium along each conveyance path, a blade configured to be rotatable around a blade center point, and that switches a conveyance route of the medium by connecting any two of the three conveyance paths, a first pair of conveyance rollers in the first conveyance path, the first pair of conveyance rollers including a first roller and a second roller facing the first roller across the first conveyance path, a second pair of conveyance rollers in the second conveyance path, the second pair of conveyance rollers including a third roller and a fourth roller facing the third roller across the second conveyance path, and a third pair of conveyance rollers in the third conveyance path, the third pair of conveyance rollers including a fifth roller and a sixth roller facing the fifth roller across the third conveyance path. The conveyance guide includes a first conveyance guide and a second conveyance guide, the first conveyance guide being disposed in vicinity of the first and second pairs of conveyance rollers and between the blade center point and the third pair of conveyance roller, the second conveyance guide being disposed in vicinity of the third pair of conveyance rollers and between the blade center point and the third pair of conveyance roller. The first conveyance guide and the second conveyance guide configured to be moved between a connected stated and a separated state. The first conveyance guide and the second conveyance guide configured to guide the medium along the third conveyance path in the connected state.

An automatic transaction device of the present disclosure includes a deposit port that receives a medium from a user, a first storage box that stores the medium that the deposit port received, a second storage box that stores the medium that the deposit port received, a conveyance guide that forms first, second and third conveyance paths that intersect, and that guides a medium-to-be-transacted along each conveyance path, a blade configured to be rotatable around a blade center point in accordance with a transaction, and that switches a conveyance route of the medium by connecting any two of the three conveyance paths a first pair of conveyance rollers in the first conveyance path, the first pair of conveyance rollers including a first roller and a second roller facing the first roller across the first conveyance path, a second pair of conveyance rollers in the second conveyance path, the second pair of conveyance rollers including a third roller and a fourth roller facing the third roller across the second conveyance path, and a third pair of conveyance rollers in the third conveyance path, the third pair of conveyance rollers including a fifth roller and a sixth roller facing the fifth roller across the third conveyance path. The first, second, and third pairs of rollers are rotatable and are configured to hand off the medium between two conveyance paths connected by the blade. The first conveyance path is a path connecting between the deposit port and the blade. The second conveyance path is a path connecting between the blade and the first storage box. The third conveyance path is a path connecting between the blade and the second storage box. The second roller is closer than the first roller to the third pair of conveyance rollers. The fourth roller is closer than the third roller to the third pair of conveyance rollers. A radius of the second roller is larger than a radius of the first roller. A first holding point is a point between the first roller and the second roller where the first pair of conveyance rollers holds the medium. A second holding point is a point between the third roller and the fourth roller where the second pair of conveyance rollers holds the medium. A third holding point is a point between the fifth roller and the sixth roller where the third pair of conveyance rollers holds the medium. A distance from the blade center point to the first holding point defines a first center holding distance. A distance from the blade center point to the second holding point defines a first center holding distance. A distance from the blade center point to the third holding point defines a first center holding distance. The first center holding distance is different from one or both of the second center holding distance and the third center holding distance.

In the present disclosure, the first pair of conveyance rollers is configured such that a radius of the first another roller is larger than a radius of the first one roller, and thereby it is no longer necessary to dispose the first, second and third pair of conveyance rollers at the same distance from the blade center point. Therefore, in the present disclosure, each pair of conveyance rollers can be disposed at various positions within a range in which the medium can be handed off between the holding points of each pair of conveyance rollers.

Advantageous Effects of Invention

According to the present disclosure, the medium processing device and the automatic transaction device can improve the degree of freedom of design while realizing switching of a conveyance path and handing off of the medium between pairs of rollers.

DESCRIPTION OF EMBODIMENTS

Hereinafter, an embodiment carrying out the invention (hereinafter, referred to as an exemplary embodiment) will be described with reference to the drawings.

1. Overall Configuration of an Automatic Teller Machine

Figure 1:
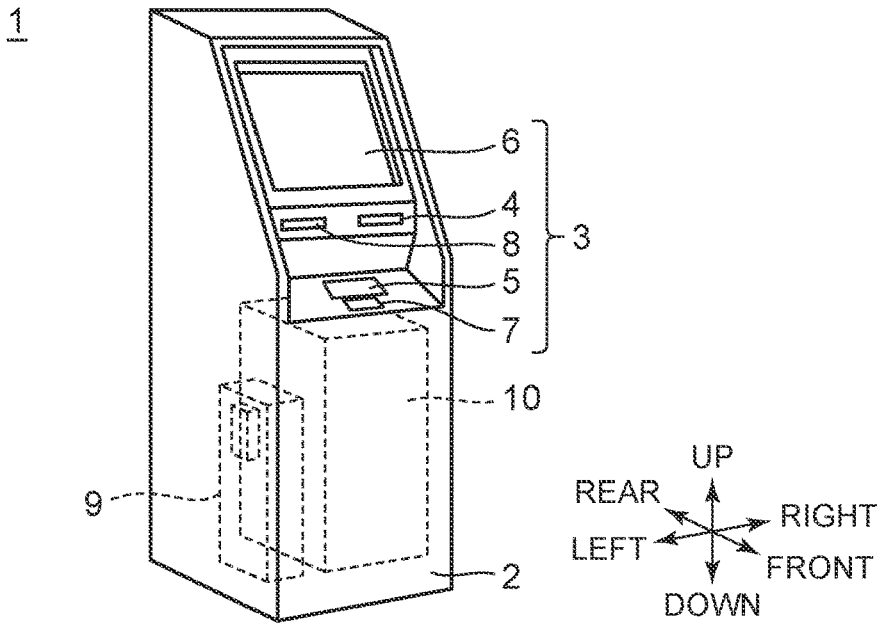
FIG. 1 is a schematic perspective view illustrating an external configuration of an ATM.

As illustrated in the external view of FIG. 1, an ATM 1 as an automatic transaction device is configured mainly by a box shaped casing 2, and is, for example, installed in a financial institution, various commercial facilities or the like to perform cash transactions such as deposit transactions and withdrawal transactions with a user (that is, a customer of the financial institution or the commercial facilities).

The casing 2 is provided with an interface section 3 at a location enabling easy banknote insertion, touch panel operation, and so on by the customer who is facing the front side of the casing 2. The interface section 3 is provided with a card insertion/removal port 4, a deposit/withdrawal port 5, an operation display section 6, a ten-key 7, and a receipt issue port 8. Cash, cards, and the like are passed between the interface section 3 and the user directly, and the interface section 3 notifies transaction information and receives operation instructions.

The card insertion/removal port 4 is a section for insertion and return of the various cards such as cash cards. A card processing unit (not illustrated in the drawings) that reads account numbers and the like magnetically recorded on the various cards is provided behind the card insertion/removal portion 4. The deposit/withdrawal port 5 is a section that is input with banknotes being deposited by a user, and that dispenses banknotes being paid out to a user. Also, the deposit/withdrawal port 5 is opened or closed by driving a shutter. The banknote is formed in a sheet-shape by, for example, rectangular paper.

The operation display section 6 is integrated with a Liquid Crystal Display (LCD) that displays operation screens during a transaction, and a touch sensor for inputting transaction type selections, PINs, transaction amounts, and the like. The ten-key 7 is a physical keypad that receives input of, for example, the numbers 0 to 9, and is employed to receive a PIN code and a transaction amount or other operations requiring a user to input information. The receipt issue port 8 is a section that issues receipts printed with transaction details and the like at the end of transaction processing. The receipt issue port 8 (not illustrated in the drawings) that prints transaction details and the like on the receipt is provided behind the receipt issue port 8.

In the following explanation, the side of the ATM 1 faced by a user is defined as the front side, and the opposite side thereto is defined as the rear side. The left side and the right side left are respectively defined by the left and right from the perspective of a user facing the front side, and the upper side and lower side are also defined from the perspective of a user facing the front side.

A main controller 9 that performs overall control of the ATM 1, a banknote deposit/withdrawal device 10 that performs various processing related to banknotes, and the like are provided inside the casing 2. The main controller 9 is configured mainly by a Central Processing Unit (CPU), not illustrated in the drawings, and reads and executes predetermined programs from Read Only Memory (ROM) or flash memory, or the like, in order to control the respective sections so as to perform various processing in deposit transactions, withdrawal transactions, and the like. The main controller 9 includes a storage section configured by Random Access Memory (RAM), a hard disk drive, flash memory, or the like inside, and store various information in the storage section.

2. Configuration of Banknote Deposit/Withdrawal Device

Figure 2:
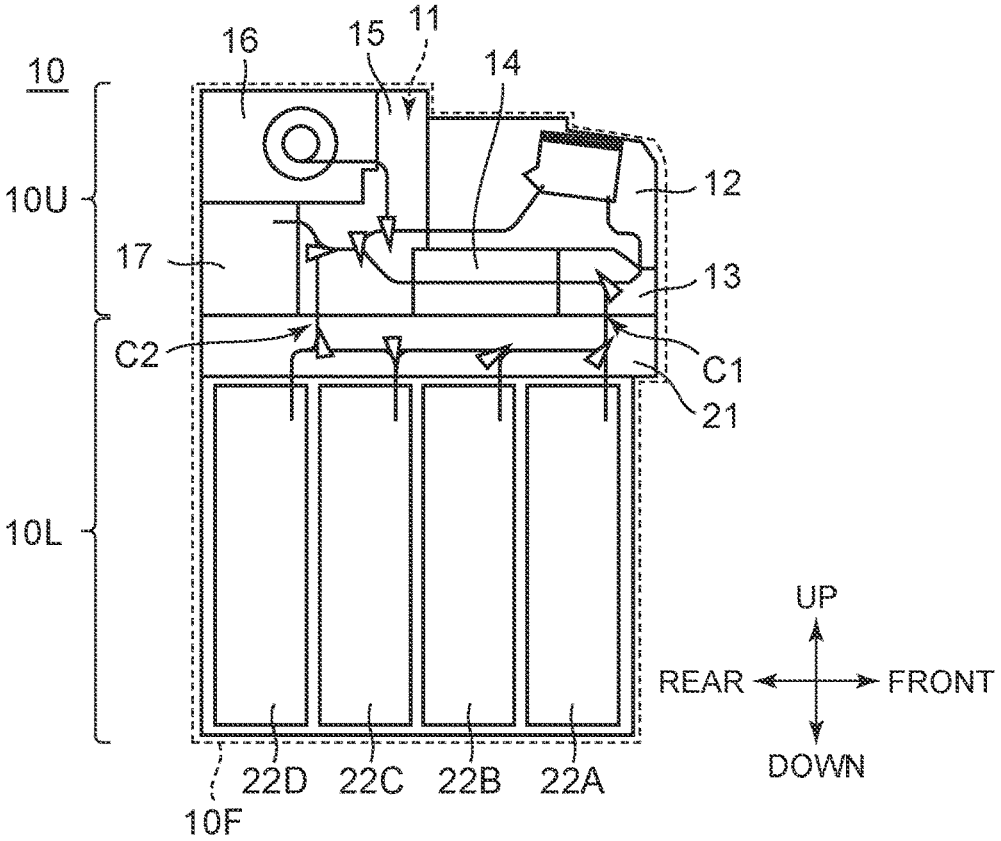
FIG. 2 is a schematic view illustrating a configuration of a banknote deposit/withdrawal device.

As illustrated in a side view of FIG. 2, the banknote deposit/withdrawal device 10 is a medium processing device made up of a plurality of parts performing various processes relating to banknotes. The banknote is formed in a thin rectangular sheet-shape, for example, using a material such as paper or resin.

The banknote deposit/withdrawal device 10 includes a banknote deposit/withdrawal device frame 10F that makes up an outer portion thereof, an upper unit 10U occupying an upper portion than substantially the center of an up-down direction in the banknote deposit/withdrawal device frame 10F, and a lower unit 10L occupying a lower portion in the banknote deposit/withdrawal device frame 10F.

Figure 3A:
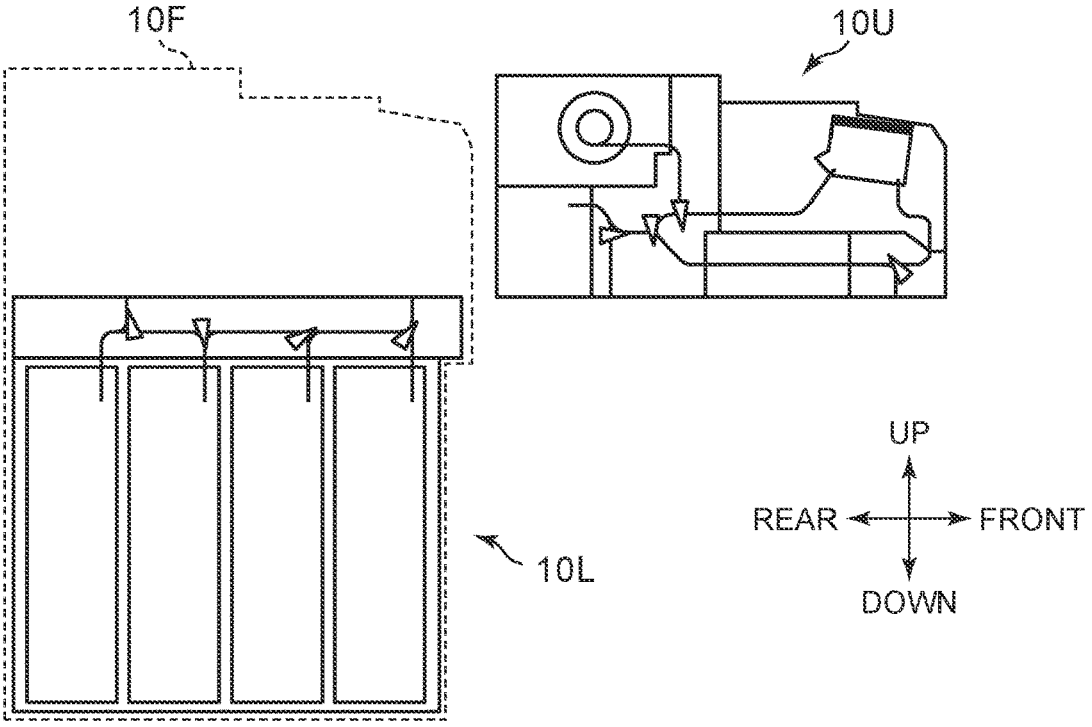
FIG. 3A is a schematic view illustrating a state of pulling out an upper unit in the banknote deposit/withdrawal device.
Figure 3B:
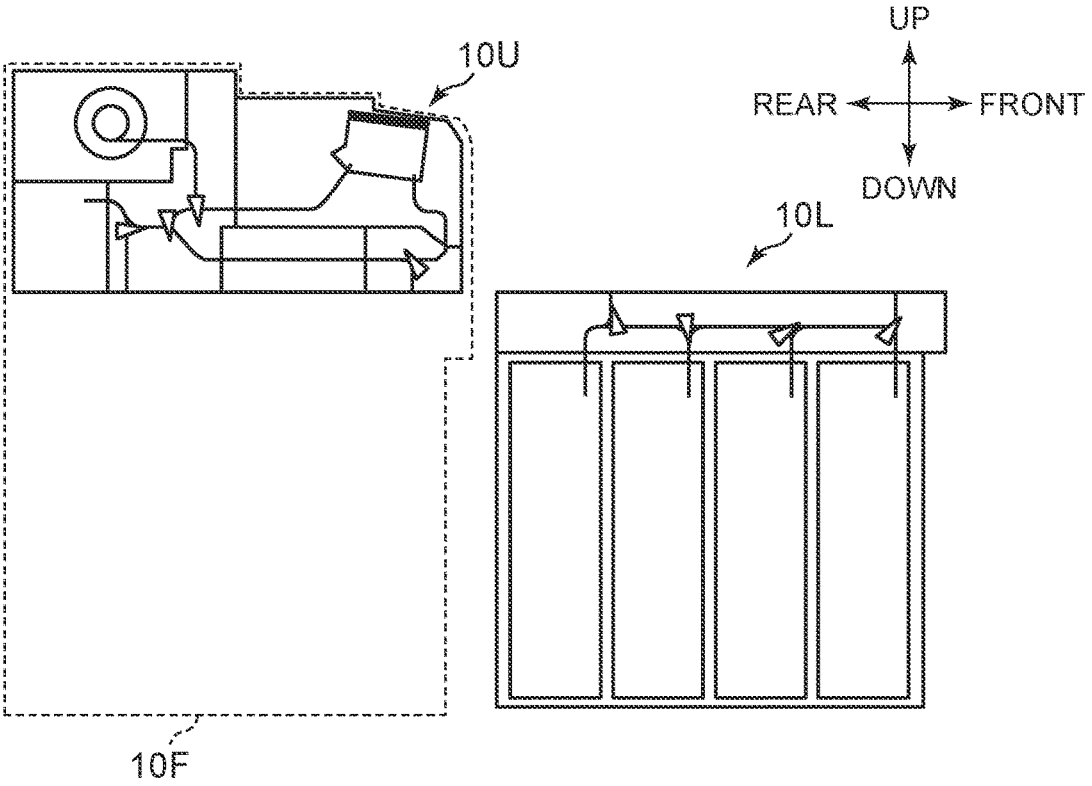
FIG. 3B is a schematic view illustrating a state of pulling out a lower unit in the banknote deposit/withdrawal device.

The banknote deposit/withdrawal device frame 10F is attached to inside the casing 2 (FIG. 1). The upper unit 10U and the lower unit 10L are attached to the banknote deposit/withdrawal device frame 10F through slide rails (not illustrated in the drawings) extending in a front-rear direction. As illustrated in FIG. 3A and FIG. 3B, in the banknote deposit/withdrawal device 10, the upper unit 10U and the lower unit 10L can be respectively drawn forward from the banknote deposit/withdrawal device frame 10F in a state where a front door of the casing 2 is opened. As illustrated in FIG. 2, in the banknote deposit/withdrawal device 10, the upper unit 10U and the lower unit 10L can be respectively stored in the banknote deposit/withdrawal device frame 10F by pushing the upper unit 10U and the lower unit 10L rearward.

2-1. Configuration of the Upper Unit

Figure 4A:
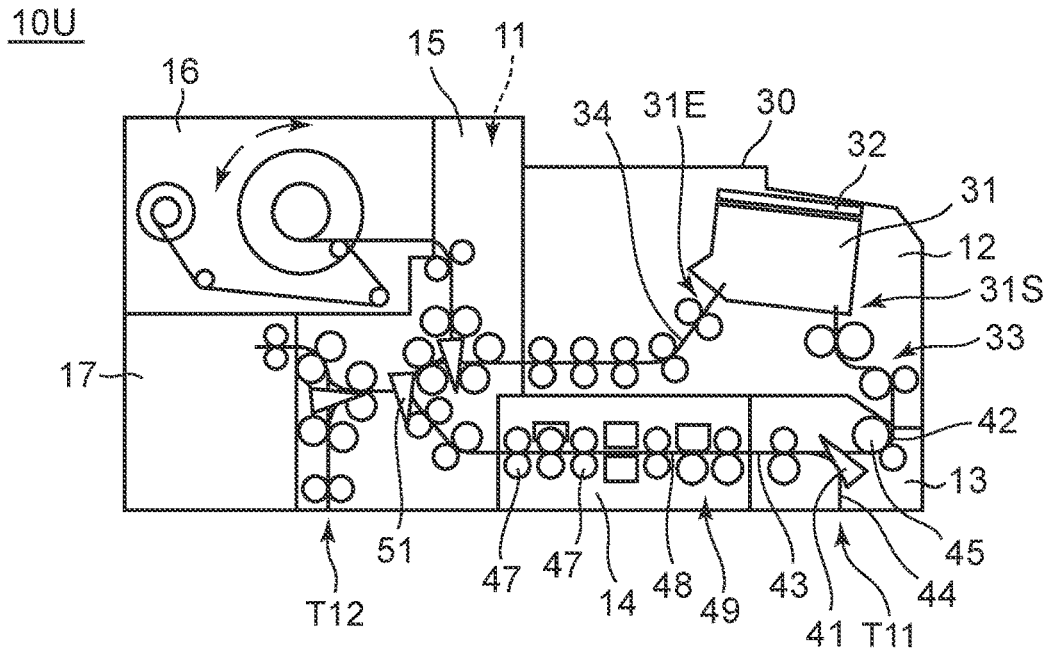
FIG. 4A is a schematic view illustrating a configuration of the upper unit.

As illustrated in FIG. 4A in which a part of FIG. 2 is enlarged, the upper unit 10U is provided with a banknote controller 11 that performs overall control of the upper unit 10U, an customer interface section 12, an upper front conveyance section 13, a classification section 14, an upper rear conveyance section 15, a temporary holding section 16 and a reject box 17.

The banknote controller 11 is made up of a Central Processing Unit (CPU), similarly to the main controller 9, and reads and executes predetermined programs from Read Only Memory (ROM) or flash memory, or the like, in order to perform various processes such as a process to determine the conveyance destination of banknotes or a process to control the operation of the each part. The banknote controller 11 includes a storage section made up of Random Access Memory (RAM), flash memory, or similar storage devices to store information in the storage section.

The customer interface section 12 gives banknotes to a user and receives banknotes from a user, thereby allowing the user to deposit banknotes or dispensing banknote to the user. The customer interface section 12 includes a container 31 that stores banknotes inside a customer interface section frame 30 making up an outer part of the customer interface section 12. An upper part of the container 31 in the customer interface section frame 30 is formed a hole penetrating in the up-down direction, and the hole is opened or closed by a movable shutter 32.

The lower front side of the container 31A is provided with a separating unit 31S that separates banknotes stored in the container 31 one by one and conveys banknotes downward. The lower side of the separating unit 31S forms a conveyance path 33 extending substantially the up-down direction. The customer interface section 12 conveys banknotes separated by the separating unit 31S downward along the conveyance path 33, and hands over to an upper front conveyance section 13 located on the lower side.

The rear lower side of the container 31 is provided with a discharging unit 31E that discharges banknotes to the container 31. The lower side of the discharging unit 31E forms a conveyance path 34 between the upper rear conveyance path 15 disposed on the rear side and the discharging unit 31E. The conveyance path 34 conveys banknotes conveyed from the upper rear conveyance section 15 frontward, and then causing to discharge banknotes from the discharging unit 31E to the container 31.

The upper front conveyance section 13 is located on the lower front side inside the upper unit 10U. An upper front switching unit 41 is disposed near the center inside the upper front conveyance section 13, and three conveyance paths, such as a conveyance path 42, a conveyance path 43 and a conveyance path 44 are formed around the upper front switching unit 41.

The upper front switching unit 41 is made up of by a conveyance guide that guides banknotes, a blade (illustrated by a triangle in the drawings) and a plurality of rollers disposed near the blade. The conveyance guide has a guide face formed in a linear or curved shape when viewed from the left-right direction and regulates travel range of the banknote by the guide face, thereby causing to guide the banknotes so as to proceed banknotes along the conveyance route. The blade is a wedge shape ("V"-shape) when viewed from the left-right direction, and guides banknotes by an oblique part of the wedge shape. The blade can be rotated to change an inclination direction. The rollers are disposed so as to face each other across the conveyance path of banknotes and transmit a driving force to banknotes by rotating.

The blade of the upper front switching unit 41 is changed (that is, an angle of inclination of the portion for guiding the banknote) in accordance with a conveyance destination of each banknote, and each roller rotates in a predetermined rotation direction, based on the control of the banknote controller 11. Hereby, a conveyance route of the banknote can be switched in two ways, and the banknote can be conveyed to the desired conveyance destination. Hereinafter, a switching unit that switches a conveyance route of the banknote in two ways, such as the upper front switching unit 41, is also referred to as a two-way switching unit. The upper front switching unit 41 can switch to a conveyance route connecting the conveyance path 42 located on the upper front side and the conveyance path 43 located on the rear side, or a conveyance route connecting the conveyance path 44 located on the lower side and the conveyance path 43 located on the rear side, based on the control of the banknote controller 11.

The classification section 14 is located at the lower side of the customer interface section 12 and the rear side of the upper front conveyance section 13. A linear classification conveyance path 48 penetrating in the front-rear direction is formed inside the classification section 14 by a plurality of conveyance guides, a pair of conveyance rollers, and the like, and various sensors 49 are disposed along the classification conveyance path 48. The sensors 49 may be made up of, for example, one or more of a magnetic sensor that reads magnetism, an image sensor that reads an image, a thickness sensor that detects the thickness of the banknote, and a traveling sensor that detects a traveling state of the banknote.

The classification section 14 sends out various detection results obtained by the sensor 49 as classification results from the banknote conveyed along the classification conveyance path 48 to the banknote controller 11. In response to this, the banknote controller 11 identifies the denomination, the authenticity, and the physical condition (the presence or absence of damage) of banknote and recognizes the conveyance state based on the classification results. Hereby, the banknote controller 11 determines a conveyance route of a banknote and a conveyance destination of a banknote based on the obtained results.

The upper rear conveyance section 15 is spaced apart from an upward/downward center line of the upper unit 10U by approximately a quarter of the distance from the upward/downward center line to the rear surface of the upper unit 10, and the upper rear conveyance section 15 is located behind the customer interface section 12 and the classification section 14. As illustrated in a schematic enlarged view in FIG. 4B, an upper rear switching unit 51 is disposed near the center inside the upper rear conveyance section 15, a temporary holding switching unit 52 is disposed in front of the upper side of the upper rear switching unit 51, a segregation switching unit 53 is disposed behind the upper rear switching unit 51, and further three conveyance paths are connected to each switching unit.

Figure 4B:
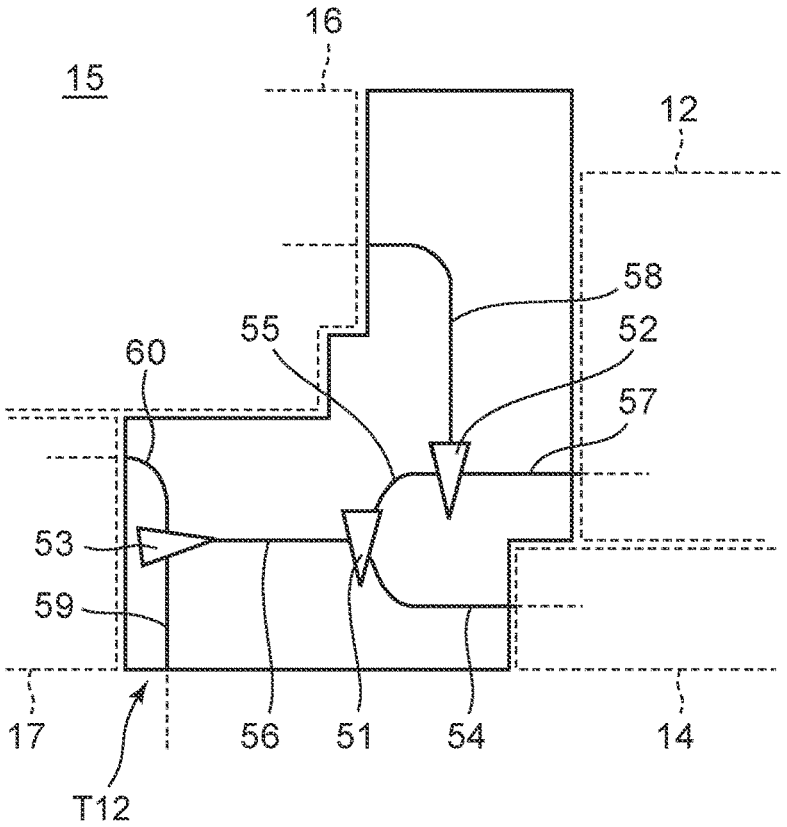
FIG. 4B is a schematic view illustrating a configuration of a rear hand-off part of the upper unit.

In the upper rear conveyance section 15, a conveyance guide that guides banknotes and a pair of conveyance rollers that transmit a driving force to banknotes are appropriately disposed, similar to the upper front conveyance section 13, and the banknotes are conveyed along the conveyance path described above. In FIG. 4B, for ease of explanation, the conveyance rollers are omitted, and the conveyance paths are illustrated by the solid lines.

The upper rear switching unit 51 is configured as a two-way switching unit similarly to the upper front switching unit 41, and is connected to a conveyance path 54 located in front of the lower side, a conveyance path 55 located in front of the upper side and a conveyance path 56 located in the rear side. Specifically, the upper rear switching unit 51 can switch to either a conveyance route connecting the conveyance path 54 located in front of the lower side and the conveyance path 55 located in front of the upper side or a conveyance route connecting the conveyance path 54 located in front of the lower side and the conveyance path 56 located the rear side.

The temporary holding switching unit 52 changes its posture by rotating the blade in the same manner as the upper rear switching unit 51, and is what is referred to as a three-way switching unit, which switches a conveyance route of banknotes in three ways, unlike the upper rear switching unit 51.

The temporary holding switching unit 52 is connected to the upper rear switching unit 51 by the conveyance path 55, is connected to a conveyance path 34 (FIG. 4A), connected to the customer interface section 12, by a conveyance path 57 located on front side of the temporary holding switching unit 52, and is connected to the temporary holding section 16 by a conveyance path 58 located on the upper side of the temporary holding switching unit 52. The temporary holding switching unit 52 can switch to, based on the control of the banknote controller 11, a conveyance route connecting the conveyance path 55 with the conveyance path 57, a conveyance route connecting the conveyance path 55 with the conveyance path 58, or a conveyance route connecting the conveyance path 57 with the conveyance path 58. In other words, the temporary holding switching unit 52 can connect any two of the upper rear switching unit 51, the customer interface section 12, or the temporary holding section 16.

The segregation switching unit 53 is configured in the same manner as the temporary holding switching unit 52, and is a three-way switching unit, which switches a conveyance route of banknotes in three ways. The segregation switching unit 53 is connected to the upper rear switching unit 51 by the conveyance path 56, is connected to an upper unit rear hand-off port T12 by a conveyance path 59, and is connected to the reject box 17 by a conveyance path 60. The segregation switching unit 53 can switch to, based on the control of the banknote controller 11, a conveyance route connecting the conveyance path 56 with the conveyance path 59, a conveyance route connecting the conveyance path 56 with the conveyance path 60, or a conveyance route connecting the conveyance path 59 with the conveyance path 60.

The temporary holding section 16 (FIG. 2) employs what is referred to as tape escrow method, and includes a drum that is formed into a cylindrical shape and rotates, a tape having one end fixed to a circumferential side face of the drum, a reel that winds the tape from the other end side, and a conveyance roller that conveys banknotes. The temporary holding section 16 conveys the banknotes near the circumferential side face of the drum when receiving the banknotes from the upper conveyance section 15, and rotates the drum, thereby storing the banknotes by wrapping the banknotes against a circumferential side face together with a tape. When the banknotes are fed out, the temporary holding section 16 peels the banknotes together with a tape from the circumferential side face of the drum by rotating the reel and rotating the drum in a direction opposite to a direction in which the banknotes are stored, and sequentially hands off the banknotes to the upper rear conveyance section 15.

The reject box 17 has a storage space for storing banknotes therein, and has a discharging mechanism for discharging banknotes into the storage space. When receiving the banknotes from the upper rear conveyance section 15, the reject box 17 discharges the banknotes into the storage space by the discharging mechanism and stores the banknotes in a stacked state. Banknotes determined to be heavily damaged and unsuitable for re-use (hereinafter, referred to as reject banknotes) are conveyed to the reject box 17 where they are stored. Specifically, the reject box 17 can segregate reject banknotes from normal banknotes which can be reused, and the reject box 17 can internally store the reject banknotes. Hereinafter, the reject box 17 is also referred to as a segregation storage box.

2-2. Configuration of the Lower Unit

Figure 5:
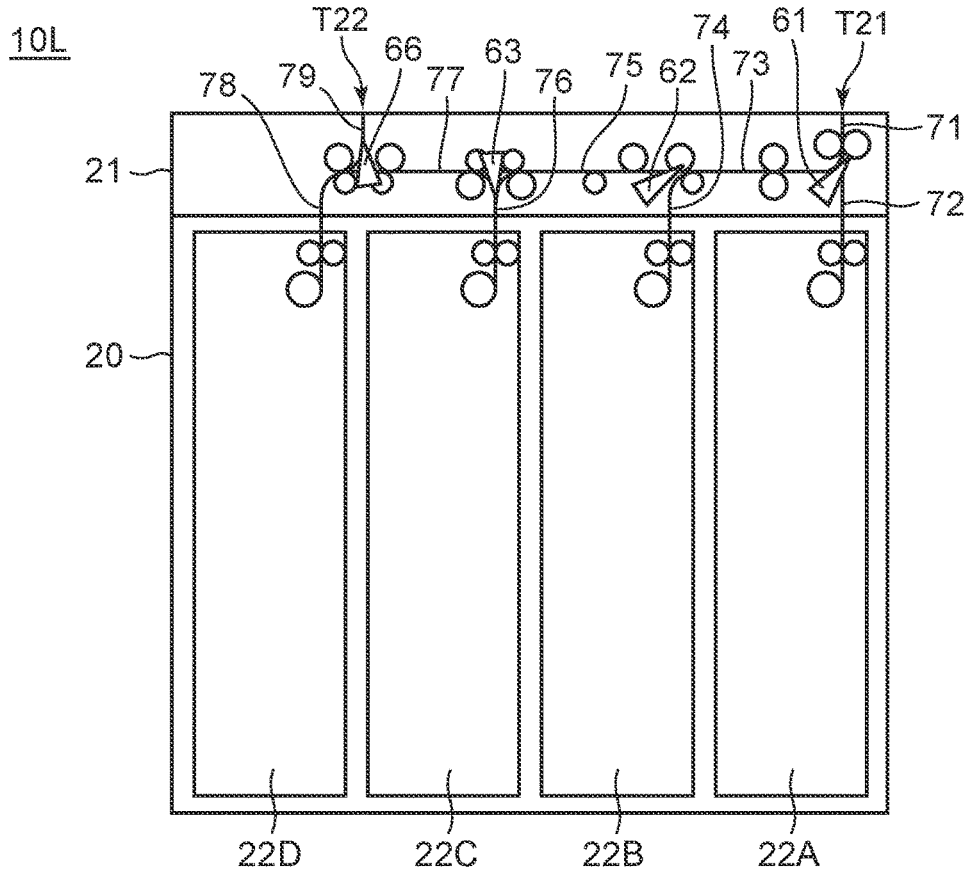
FIG. 5 is a schematic view illustrating a configuration of the lower unit.

As illustrated in FIG. 5 in which a part of FIG. 2 is enlarged, a lower conveyance section 21 that conveys banknotes substantially in the front-rear direction is disposed at an upper end portion of the lower unit 10L. A lower frame 20 is provided below the lower conveyance section 21. The lower frame 20 is formed in a hollow cuboidal shape. The upper side of the lower frame 20 is open, and an internal space of the lower frame 20 is partitioned into four spaces by providing three partitioning plates (not illustrated in the drawings) in the front-rear direction. Hereinafter, each partitioned space is also referred to as a loading space.

In each loading space in the lower frame 20, four banknote storage boxes 22 (22A, 22B, 22C and 22D) that store banknotes, which can be reused (recycled) are disposed in the front-rear direction. The four banknote storage boxes 22 (22A, 22B, 22C and 22D) are disposed in order from the front side to the rear side.

A hinge (not illustrated in the drawings) is provided in the vicinity of the upper right end in the lower frame 20, thereby rotatably supporting the lower conveyance section 21 by the hinge. In other words, the lower frame 20 can open or close the upper side thereof by rotating the lower conveyance section 21 using the hinge as a center of rotation. When the lower conveyance section 21 rotates rightward and the upper side of the lower frame 20 is opened, in a state where the lower unit 10L is pulled forward from the banknote deposit/withdrawal device frame 10F (FIG. 3B), each of the banknote storage boxes 22 can be take out from each of the loading spaces or each of the banknote storage boxes 22 can be loaded into each of loading spaces.

Each of the banknote storage boxes 22 (22A, 22B, 22C and 22D) is similarly configured, and is formed in a cuboidal shape that is longer in the up-down direction than in the front-rear direction. Each of the banknote storage boxes 22 is provided with a storage space for accumulating and storing banknotes, a separating and discharging unit disposed above the storage space for separating and discharging banknotes, and a storage box conveyance unit for conveying banknotes between the separating and discharging unit and the upper end of the banknote storage box 22. Each of the banknote storage boxes 22 is designated to store banknotes of a predetermined.

When receiving banknotes from the lower conveyance section 21 in a case of performing a storage process to store banknotes, the banknote storage box 22 conveys banknotes to the separating and discharging unit by the storage box conveyance section and discharges banknotes into the storage space, thereby storing banknotes in the storage space in an accumulated state. One the other hand, in a case of performing a feeding process to feed out banknotes, the banknote storage box 22 separates banknotes accumulated into the storage space one by one by the separating and discharging unit, and thereby these banknotes are conveyed above by the storage box conveyance unit and are handed off to the lower conveyance section 21.

A switching unit 61 is disposed in vicinity of the front end inside the lower conveyance section 21 (FIG. 5) and almost directly above the banknote storage box 22A. In the lower conveyance section 21, a switching unit 62 is disposed behind the switching unit 61 and almost directly above the banknote storage box 22B, and a switching unit 63 is disposed behind the switching unit 62 and almost directly above the banknote storage box 22C. Further, a switching unit 66 is disposed behind the switching unit 63.

The switching unit 61 and the switching unit 62 are configured as two-way switching units, similar to the upper front switching unit 41 in the upper unit 10U (FIG. 4A). Similar to the upper front switching unit 41, the switching unit 61 and the switching unit 62 each have three conveyance paths directed toward them, with a plurality of conveyance rollers and conveyance guides guiding a banknote toward and away from the switching units 61 and 62.

A conveyance path 71 going upward, a conveyance path 72 going downward and connected to the banknote storage box 22A, and a conveyance path 73 going rearward and connected to the switching unit 62 are provided around the switching unit 61. The switching unit 61 can switch to a conveyance route connecting the conveyance path 71 located in the upper side and a conveyance path 72 located in the lower side, or a conveyance route connecting a conveyance path 71 located in the upper side and the conveyance path 73 located in the rear side. The upper end of the conveyance path 71 is provided with a lower unit front hand-off port T21, and thereby banknotes can be mutually handed off between an upper unit front hand-off port T11 of the upper unit 10U (FIG. 4A) and the lower unit front hand-off port T21.

A conveyance path 74 going downward and connected to the banknote storage box 22B and a conveyance path 75 going rearward and connected to the switching unit 63 are provided around the switching unit 62, in addition to the conveyance path 73. The switching unit 62 can switch to a conveyance route connecting the conveyance path 73 located in the front side and the conveyance path 74 located in the lower side, or a conveyance route connecting the conveyance path 73 located in the front side and the conveyance path 75 located in the rear side.

The switching unit 63 and the switching unit 66 are three-way switching units, similar to the temporary holding switching unit 52 of the upper unit 10U (FIG. 4A), and can switch a conveyance route of banknotes in three ways (described in detail later) by changing an inclination direction of a blade based on the control of the banknote controller 11. Three conveyance paths, as well as conveyance rollers and conveyance guides, are respectively formed around each of the switching unit 63 and the switching unit 66.

Around the switching unit 63, a conveyance path 76 going downward and connected to the banknote storage box 22C as a bidirectional storage box, and a conveyance path 77 going rearward and connected to a switching unit 66 are provided, in addition to the conveyance path 75 as a second conveyance path. The switching unit 63 can switch to a conveyance route connecting the conveyance path 75 located on the frontward side of the switching unit 63 and the conveyance path 76 located on the rearward side of the switching unit 63, a conveyance route connecting the conveyance path 75 located on the frontward side of the switching unit 63 and the conveyance path 77 located on the rearward side of the switching unit 63, or a conveyance route connecting the conveyance path 77 located on the rearward side of the switching unit 63 and the conveyance path 76 located on the downward side of the switching unit 63.

Around the switching unit 66, a conveyance path 78 going rearward and downward and connected to the banknote storage box 22D, and a conveyance path 79 going upward are provided, in addition to the conveyance path 77. The switching unit 66 can switch to a conveyance route connecting the conveyance path 77 located on the frontward side of the switching unit 66 and the conveyance path 78 located on the rearward side of the switching unit 66, a conveyance route connecting the conveyance path 77 located on the frontward side of the switching unit 66 and the conveyance path 79 located on the upward side of the switching unit 66, or a conveyance route connecting the conveyance path 78 located on the rearward side of the switching unit 66 and the conveyance path 79 located on the upper side. The upward end of the conveyance path 79 is provided with a lower unit rear hand-off port T22, and thereby banknotes can be mutually handed off between the upper unit rear hand-off port T12 of the upper unit 10U (FIG. 4A) and the lower unit rear hand-off port T22.

With this configuration, for example, when banknotes are conveyed from the upper unit 10U (FIG. 4A) via the lower unit front hand-off port T21, the lower conveyance section 21 can convey banknotes and store them into the banknote storage boxes 22 (22A, 22B, 22C and 22D), or return banknotes to the upper unit 10U from the lower unit rear hand-off port T22. When receiving banknotes from the banknote storage boxes 22 (22A, 22B, 22C and 22D), the lower conveyance section 21 can convey banknotes to the lower unit front hand-off port T21 and also hand off banknotes to the upper unit 10U.

For example, when banknotes are conveyed from the upper unit 10U via the lower unit rear hand-off port T22, the lower conveyance section 21 can convey banknotes and store them into banknote storage box 22C or the banknote storage box 22D. When receiving banknotes from the banknote storage box 22C or the banknote storage box 22D, the lower conveyance section 21 can convey banknotes to the lower unit rear hand-off port T22 and hand off to the upper unit 10U.

The lower conveyance section 21 can appropriately sort banknotes conveyed from the upper unit 10U and convey to each of banknote storage boxes 22 (22A, 22B, 22C and 22D), thereby storing banknotes into each of banknote storage boxes 22 (22A, 22B, 22C and 22D). Hereinafter, the lower conveyance section 21 is also referred to as a sorting conveyance unit.

3. Various Processes in the Banknote Deposit/Withdrawal Device

Figure 6:
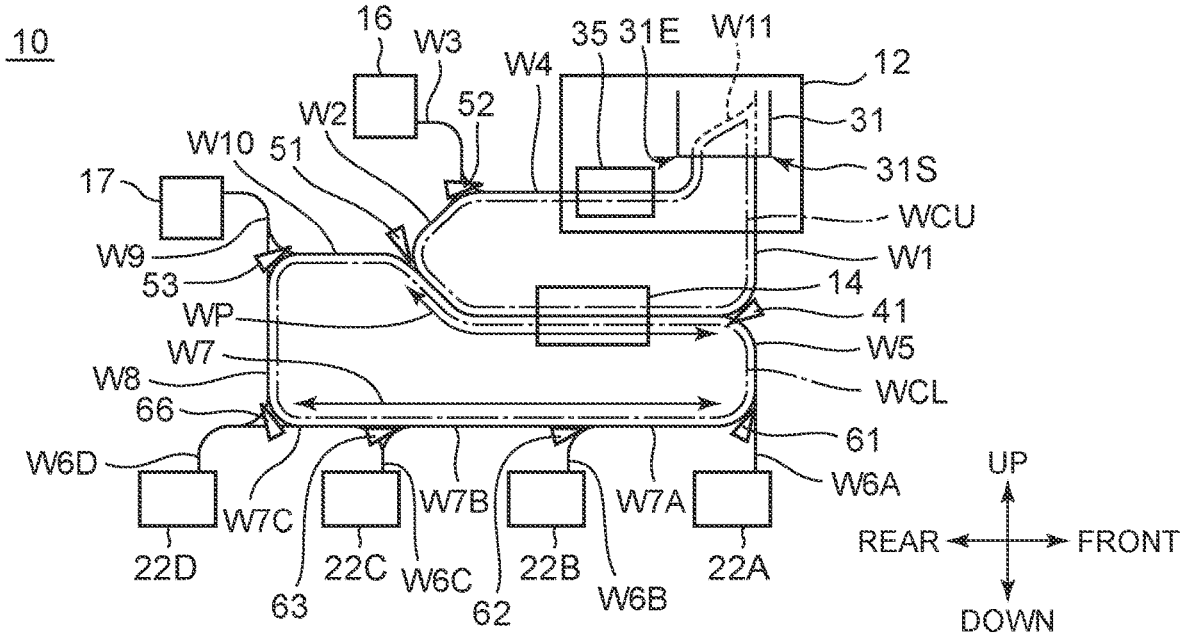
FIG. 6 is a schematic view illustrating a configuration of the banknote deposit/withdrawal device.

A banknote deposit/withdrawal device 10 (FIG. 2, FIG. 4A, FIG. 4B and FIG. 5) is schematically illustrated in FIG. 6. Processes for conveying banknotes in a deposit process and a withdrawal process will be described in detail below.

In the banknote deposit/withdrawal device 10, the upper unit 10U and the lower unit 10L are housed into the banknote deposit/withdrawal frame 10F (FIG. 2), and thereby the upper unit front hand-off port T11 (FIG. 4A) and the lower unit front hand-off port T21 are connected in vicinity of the front end of the upper unit 10U and the lower unit 10L. Further, in the banknote deposit/withdrawal device 10, the upper unit rear hand-off port T12 (FIG. 4A) and the lower unit rear hand-off port T22 (FIG. 5) are connected in vicinity of rear end in the upper unit 10U and the lower unit 10L.

In FIG. 6, the customer interface section 12, the classification section 14, the temporary holding section 16, the reject box 17 and the banknote storage boxes 22 (22A, 22B, 22C and 22D) are respectively represented by simple rectangles. Hereinafter, the banknote storage boxes 22 (22A, 22B, 22C and 22D) may also simply referred to as modules. Further, in FIG. 6, the upper front switching unit 41 disposed in the upper front conveyance section 13, the upper rear switching unit 51, the temporary holding switching unit 52 and the segregation switching unit 53 disposed in the upper rear conveyance section 15, and the switching unit 61, the switching unit 62, the switching unit 63 and the switching unit 66 disposed in the lower conveyance section 21 are respectively represented by a simply triangles. Hereinafter, these are also simply referred to as switching units.

In FIG. 6, a conveyance path connecting each of modules and each of switching units is represented by a line segment (that is, a straight line, a curve, or a combination thereof). However, in some parts of FIG. 6, a plurality of conveyance paths connecting each of modules and each of conveyance sections to each other are collectively explained to as one conveyance path.

A main conveyance path WP corresponds to the conveyance path 43 in the upper front conveyance section 13, the classification conveyance path 48 in the classification section 14 and the conveyance path 54 in the upper rear conveyance section 15. That is, the main conveyance path WP is a conveyance path extending substantially in the front-rear direction that connects the upper front switching unit 41 and the upper rear switching unit 51 and penetrates the classification section 14.

A conveyance path W1 corresponds to the conveyance path 33 in the customer interface section 12 and the conveyance path 42 in the upper front conveyance section 13. A conveyance path W2 corresponds to the conveyance path 55 in the upper rear conveyance section 15. A conveyance path W3 corresponds to the conveyance path 58 in the upper rear conveyance section 15. A conveyance path W4 corresponds to the conveyance path 57 in the upper rear conveyance section 15 and the conveyance path 34 in the customer interface section 12. A conveyance path W5 corresponds to the conveyance path 44 in the upper front conveyance section 13 and the conveyance path 71 in the lower conveyance section 21.

A conveyance path W6A, a conveyance path W6B, a conveyance path W6C and a conveyance path W6D correspond to the conveyance path 72, the conveyance path 74, the conveyance path 76 and the conveyance path 78 respectively. The conveyance path W6A, the conveyance path W6B, the conveyance path W6C and the conveyance path W6D are collectively referred to as a conveyance path W6. A conveyance path W7A, a conveyance path W7B and a conveyance path W7C correspond to the conveyance path 73, the conveyance path 75 and the conveyance path 77 in the lower conveyance section 21 respectively. The conveyance path W7A, the conveyance path W7B and the conveyance path W7C are collectively referred to as a conveyance path W7.

A conveyance path W8 corresponds to the conveyance path 79 in the lower conveyance section 21 and the conveyance path 59 in the upper rear conveyance section 15. A conveyance path W9 corresponds to the conveyance path 60 in the upper rear conveyance section 15. A conveyance path W10 corresponds to the conveyance path 56 in the upper rear conveyance section 15. In addition, in the container 31 in the customer interface section 12, banknotes discharged from the discharging unit 31E can be taken in again from the separating unit 31S and conveyed to the conveyance path W1. Hereinafter, it is deemed that a virtual connecting path W11 connecting the discharging unit 31E and the separating unit 31S is formed inside the container 31.

Herein, when looking again at FIG. 6, in the banknote deposit/withdrawal device 10, a loop shaped conveyance path is respectively formed in the upper side and the lower side of the classification section 14. That is, in the upper side of the classification section 14, the loop shaped conveyance path is formed by the main conveyance path WP, the conveyance path W2, the conveyance path W4, the conveyance path W11 and the conveyance path W1, clockwise from the upper front switching unit 41. Hereinafter, the loop-shaped conveyance path is also referred to as a upper loop-shaped conveyance path WCU.

In the lower side of the classification section 14, a loop-shaped conveyance path is formed by the conveyance path W5, the conveyance path W7, the conveyance path W8, the conveyance path W10 and the main conveyance path WP, clockwise from the upper front switching unit 41. Hereinafter, the loop-shaped conveyance path is also referred to a lower loop-shaped conveyance path WCL. Further, hereinafter, the conveyance path W6D branched from the lower loop-shaped conveyance path WCL is referred to as a branch conveyance path, and the banknote storage box 22D is referred to as a branch storage box.

3-1. Deposit Process and Storage Process

First, a case where the ATM 1 (FIG. 1) executes a deposit transaction with a user (that is, a customer of a financial institution) will be described. In this case, the banknote deposit/withdrawal device 10 performs the deposit process in a first stage (also referred to as a deposit count process or a receiving process) in which the number of banknotes is counted while classifying the denomination and the like of deposited banknotes. The deposit/withdrawal device 10 also performs a storage process in a subsequent second stage (also referred to as a deposit storage process) in which each banknote is conveyed to, and stored in, the appropriate storage location.

More specifically, when an operation input for starting the deposit transaction is received from a user via the operation display section 6 (FIG. 1), the banknote controller 11 of the banknote deposit/withdrawal device 10 starts the deposit process by cooperating with the main controller 9 (FIG. 1) of the ATM 1. The banknote deposit/withdrawal device 10 first opens the shutter 32 (FIG. 4) of the customer interface section 12, and allows the user to insert banknotes into the container 31. Next, when an input is received from the user via the operation display section 6 (FIG. 1) to begin receiving banknotes, the banknote controller 11 closes the shutter 32 of the customer interface section 12, and then the separating unit 31S separates banknotes in the container 31 one-by-one. The banknote controller 11 sequentially hands off banknotes to the conveyance path W1 located on a downstream side of the separating unit 31S.

Figure 7A:
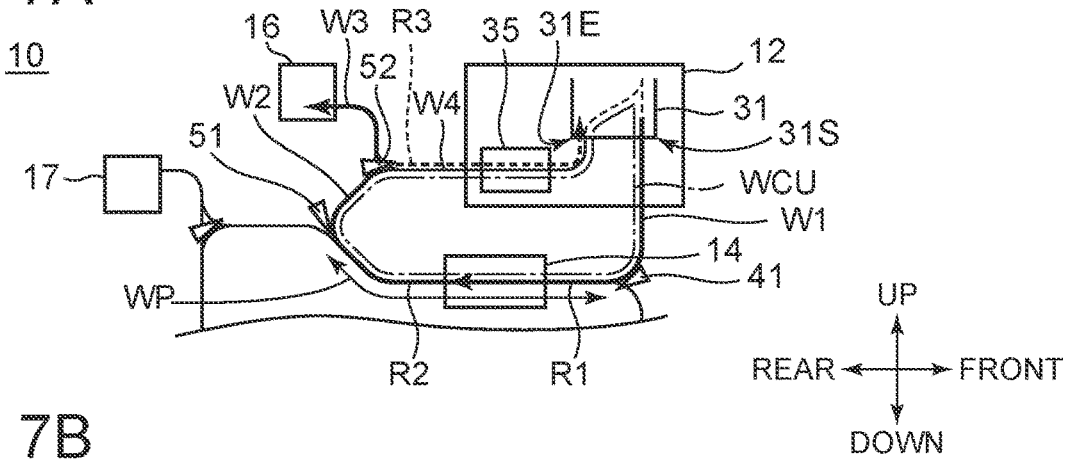
FIG. 7A is a schematic view illustrating a conveyance route of banknotes in a deposit process.

As illustrated by an arrow direction R1 in FIG. 7A, the banknote deposit/withdrawal device 10 conveys banknotes along the conveyance path W1 and the main conveyance path WP, and the banknotes are classified by the classification section 14. The banknote deposit/withdrawal device 10 then supplies the obtained classification results to the banknote controller 11. In response to this, the banknote controller 11 identifies the denomination, the authenticity, and the physical condition (the presence or absence of damage) of banknote based on the obtained classification results. Next, the banknote controller 11 identifies whether each banknote can be identified as a normal banknote to be a deposit-acceptable banknote, which may continue on to subsequent processing. Each banknote that cannot be identified as a normal banknote is identified as a deposit-reject banknote that should provisionally be given back to the user. The banknote controller 11 counts and stores the number of the deposit-reject banknotes.

The banknote deposit/withdrawal device 10 conveys banknotes while switching a conveyance route in accordance with a classification result of each banknote based on the control of the banknote controller 11. More specifically, as illustrated by an arrow direction R2, the banknote deposit/withdrawal device 10 continues to convey the deposit-acceptable banknotes along the main conveyance path WP, and then sequentially hands off the banknotes to the temporary holding section 16 by conveying along the conveyance path W2 and the conveyance path W3, and the banknotes are stored in the temporary holding section 16.

On the other hand, the banknote deposit/withdrawal device 10 conveys the deposit-reject banknotes to the temporary holding switching unit 62 in the same manner as the deposit-acceptable banknotes, and then conveys the deposit-reject banknotes along the conveyance path W4 as illustrated by an arrow direction R3, thereby causing to advance the deposit-reject banknotes into the customer interface section 12. At this time, the customer interface section 12 preliminarily sets a stacking conveyance section 35 in a stackable state, thereby sequentially discharging the deposit-reject banknotes into a stacking space of the stacking conveyance section 35 and stacking them in a bundle shape.

Eventually, the banknote deposit/withdrawal device 10 finishes paying out all banknotes from the container 31 of the customer interface section 12. At this time, if one or more banknotes (that is, deposit-reject banknotes) are stored into the stacking conveyance section 35, the stacking conveyance section 35 shifts to a conveyable state. Thereby, the stacking conveyance section 35 conveys the deposit-reject banknotes stacked in the bundle shape to the discharging unit 31E along the conveyance path W4, and resulting in the deposit-reject banknotes being discharged into the container 31.

On the other hand, if no banknote is stored in the stacking conveyance section 35, the banknote deposit/withdrawal device 10 completes the deposit process. At this time, the banknote deposit/withdrawal device 10 calculates, in the banknote controller 11, a deposit amount based on a counting result of denomination and the number of banknotes taken in from the customer interface section 12, and displays a predetermined operation instruction screen on the operation display section 6 (FIG. 1). Thereby, the banknote deposit/withdrawal device 10 presents the user with the deposit amount and prompts the user to select whether or not to continue the deposit transaction.

Herein, when the user provides an instruction to the deposit/withdrawal device 10 to cancel the deposit transaction, the banknote deposit/withdrawal device 10 sequentially conveys all banknotes held in the temporary holding section 16 along the conveyance path W3 and the conveyance path W4, and discharges the banknotes into the container 31, thereby returning the banknotes to the user by opening the shutter 32 (FIG. 4A and FIG. 4B).

Figure 7B:
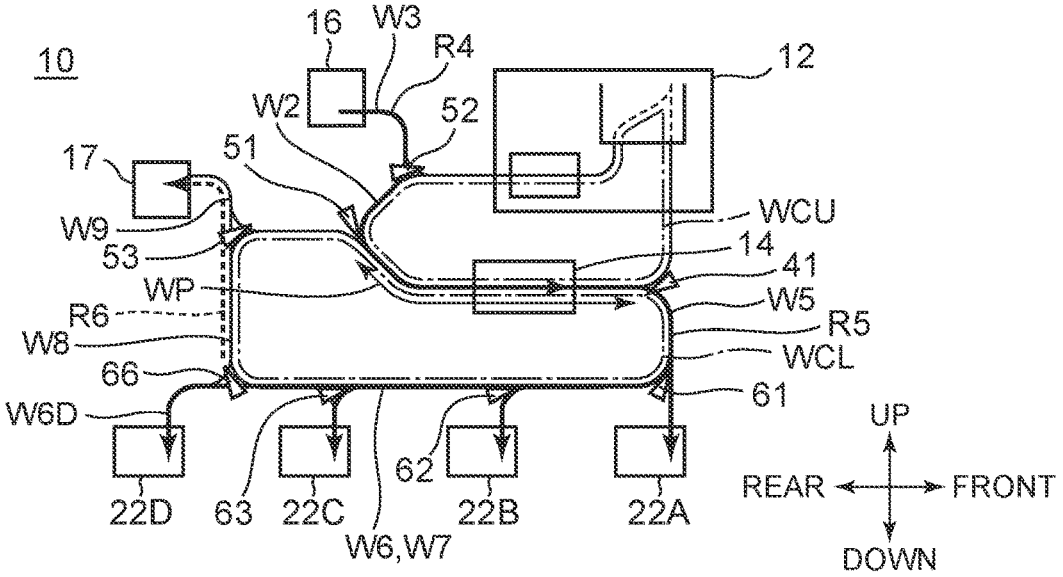
FIG. 7B is a schematic view illustrating a conveyance route of banknotes in a storage process.

On the other hand, as illustrated in FIG. 7B, the banknote deposit/withdrawal device 10 starts the storage process when the user provides an instruction to the deposit/withdrawal device 10 to continue the deposit transaction. More specifically, the banknote controller 11 sequentially feeds out the banknotes stored in the temporary holding section 16 (deposit-acceptable banknotes) and sequentially conveys them to the classification section 14 along the conveyance path W3, the conveyance path W2 and the main conveyance path WP, as illustrated by an arrow direction R4, where the banknotes are sequentially classified. At this time, the banknote controller 11 determines, based on the classification result obtained from the classification section 14, whether the destination of the banknote is the reject box 17, in the case of the reject banknote or one of the banknote storage boxes 22 (22A, 22B, 22C and 22D), in the case of the normal banknotes which can be reused.

Subsequently, the banknote deposit/withdrawal device 10 continuously conveys the normal banknotes along the main conveyance path WP as illustrated by an arrow direction R5, and further conveys them along a part of the conveyance path W5, the conveyance path W6 and the conveyance path W7. Thereby, the normal banknotes are stored to each of banknote storage boxes 22 (22A, 22B, 22C and 22D), which is as a conveyance destination corresponding to each denomination. The banknote deposit/withdrawal device 10 conveys the reject banknote to the switching unit 66 along the arrow direction R5, and then conveys and stores the reject banknote to the reject box 17 along the conveyance path W8 and the conveyance path W9 as illustrated by an arrow direction R6.

The banknote deposit/withdrawal device 10 is capable of sorting and storing normal banknotes that may be re-used in each of the banknote storage boxes 22, and the deposit/withdrawal device 10 is also capable of storing reject banknotes that should not be re-used in the reject box 17. Eventually, the banknote deposit/withdrawal device 10 finishes the storage process when all banknotes stored in the temporary holding section 16 have been conveyed to each conveyance destination.

3-2. Withdrawal Process

Next, a case where the ATM 1 (FIG. 1) executes a withdrawal transaction with a user will be described. In this case, the banknote deposit/withdrawal device 10 performs the withdrawal process to withdraw a denomination and a number of banknotes according to an amount specified by a user.

More specifically, when a user provides an input to start the withdrawal transaction, or when an inputs a withdrawal amount via the operation display section 6 (FIG. 1), the banknote controller 11 of the banknote deposit/withdrawal device 10 starts the withdrawal process by cooperating with the main controller 9 (FIG. 1) of the ATM 1. At this time, the banknote controller 11 first determines denomination and a number of banknotes according to the withdrawal amount. Subsequently, the banknote deposit/withdrawal device 10 feeds out the banknotes stored in each of banknote storage boxes 22 while separating them one by one according to the determined denomination and the number of banknotes, and sequentially hands off the banknotes to the downstream conveyance path W6.

Figure 8:
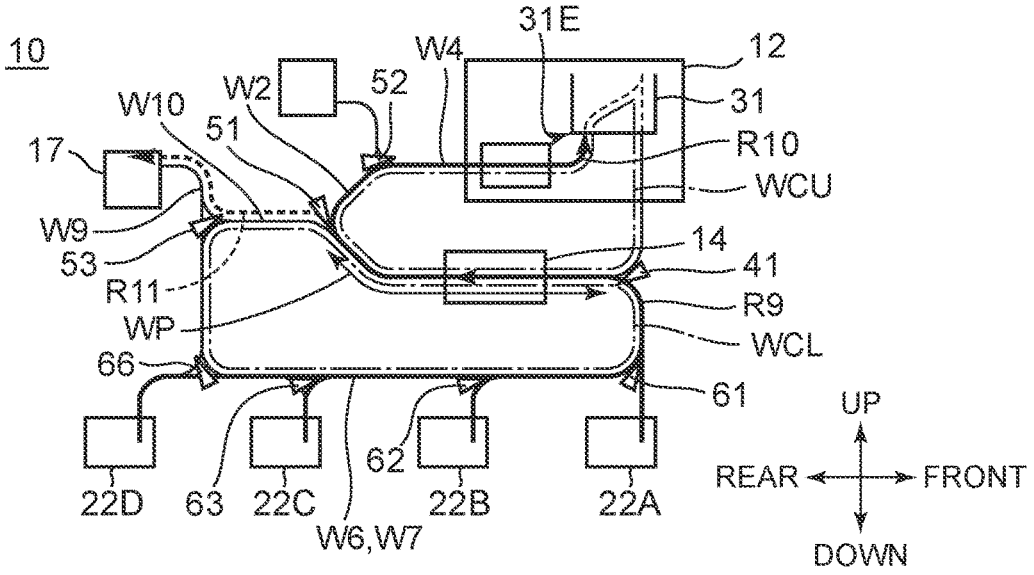
FIG. 8 is a schematic view illustrating a conveyance route of banknotes in a withdrawal process.

Subsequently, the banknote deposit/withdrawal device 10 conveys the banknotes along the conveyance path W6, the conveyance path W7, the conveyance path W5 and the main conveyance path WP as illustrated by an arrow direction R9 in FIG. 8, thereby classifying the banknotes when passing through the classification section 14. Here, in the basis of a the traveling state among the classification result obtained from the classification section 14, the banknote controller 11 determines the customer interface section 12 as a conveyance destination of normal banknotes, while the banknote controller 11 determines the reject box 17 as a conveyance destination of reject banknotes having a problem in a traveling state, such as a state where multiple banknotes are overlapped.

As illustrated by an arrow direction R10, the banknote deposit/withdrawal device 10 conveys the normal banknote to the downstream customer interface section 12 along the main conveyance path WP, the conveyance path W2 and the conveyance path W4, and discharges and stacks the normal banknotes into the container 31. The customer interface section 12 sets the stacking conveyance section 35 in the conveyable state, resulting in the banknotes being discharged directly into the container 31, and being stacked in the container 31, without stacking the banknotes to the stacking conveyance section 35. After that, the banknote deposit/withdrawal device 10 opens the shutter 32 of the customer interface section 12 (FIG. 4A and FIG. 4B), and pays out the banknotes stored in the container 31. Thereby, the user can take the banknotes from the container 31. Further, the banknote controller 11 conveys the reject banknotes to the upper rear switching unit 51 along the arrow direction R10, and then conveys them to the reject box 17 along the conveyance path W10 and the conveyance path W9, to store them inside the reject box 17, as illustrated by the arrow direction R11.

3-3. Rearward Banknote Movement Process

Next, a banknote movement process to be moved between the banknote storage boxes 22 in the banknote deposit/withdrawal device 10 will be described. Here, a case will be described in which the banknotes are moved substantially rearward with the banknote storage box 22 (22A or 22B) located in the front side as a movement source and the banknote storage box (22C or 22D) located in the rear side as a movement destination. Hereinafter, this process is also referred to as the rearward banknote movement process.

More specifically, when the banknote deposit/withdrawal device 10 receives an instruction such as the banknote storage boxes 22 of the movement source and the movement destination and the number of banknotes to be moved from a financial institution staff via the operation display section 6 (FIG. 1), the banknote movement process is started. In the same manner as in the case of the withdrawal process (FIG. 8), the banknote deposit/withdrawal device 10 feeds out the banknotes stored therein while separating the banknotes one by one from the banknote storage box 22A or 22B designated as the movement source, and then sequentially hands off the banknote to the downstream conveyance path W6A or the conveyance path W6B.

Figure 9:
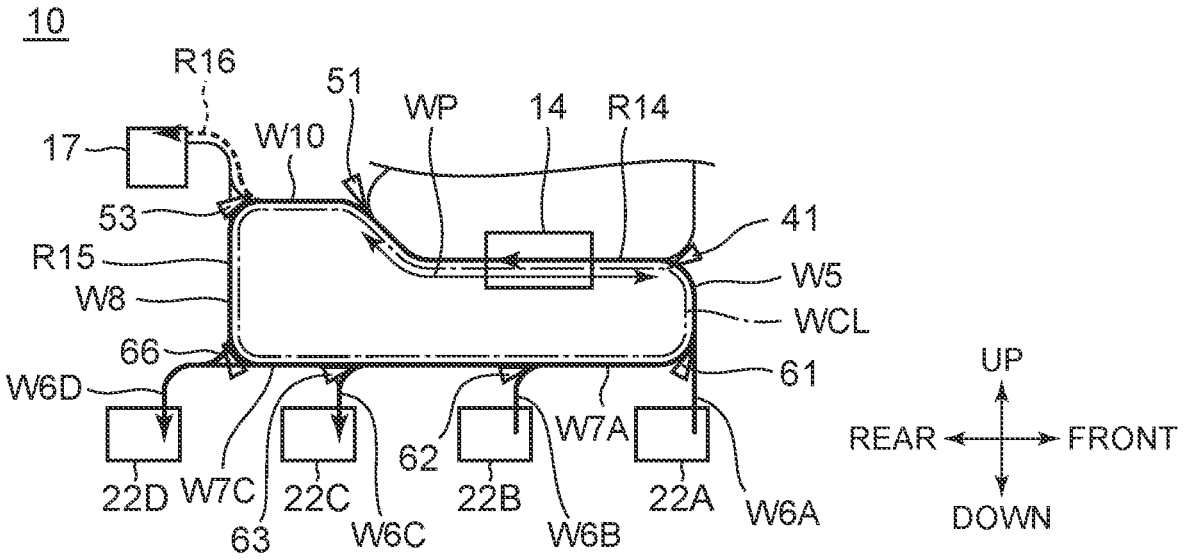
FIG. 9 is a schematic view illustrating a conveyance route of banknotes in a rearward banknote movement process.

Subsequently, as illustrated by an arrow direction R14 in FIG. 9, the banknote deposit/withdrawal device 10 conveys banknotes along the conveyance path W6 (W6A or W6B), the conveyance path W7A, the conveyance path W5 and the main conveyance path WP, thereby classifying the banknotes when passing through the classification section 14. Here, the banknote controller 11 identifies a traveling state based on the classification result, and thereby the banknote controller 11 determines the banknote storage boxes 22 as a conveyance destination of normal banknotes, while the banknote controller 11 determines the reject box 17 as a conveyance destination of reject banknotes having a problem in a traveling state.

As illustrated by an arrow direction R15, the banknote deposit/withdrawal device 10 conveys and stores the normal banknotes into the banknote storage box (22C or 22D) as the movement destination along the main conveyance path WP, the conveyance path W10, the conveyance path W8, the conveyance path W7C, and the conveyance path W6 (W6C or W6D). Further, the banknote deposit/withdrawal device 10 conveys the reject banknotes to the segregation switching unit 53 in the arrow direction R15, and then conveys the reject banknotes along the conveyance path W9 as illustrated by an arrow direction R16 to the reject box 17 and stores the reject banknotes in the reject box 17.

3-4. Forward Banknote Movement Process

Next, in the banknote movement process in the banknote deposit/withdrawal device 10, a case will be described in which the banknotes are moved substantially frontward with the banknote storage box 22 (22C or 22D) located in the rear side as a movement source and the banknote storage box (22A or 22B) located in the front side as a movement destination. Hereinafter, this process is also referred to as the forward banknote movement process.

More specifically, when the banknote deposit/withdrawal device 10 receives an instruction via the operation display section 6 (FIG. 1) by financial institution staff indicating a source, a destination, and a number of banknotes to be moved, the banknote movement process is started. In the same manner as in the case of the withdrawal process (FIG. 8), the banknote deposit/withdrawal device 10 feeds out the banknotes stored therein while separating the banknotes one-by-one from the banknote storage box 22C or 22D designated as the movement source, and sequentially hands off the banknotes to the downstream conveyance path W6C or the conveyance path W6D.

Figure 10:
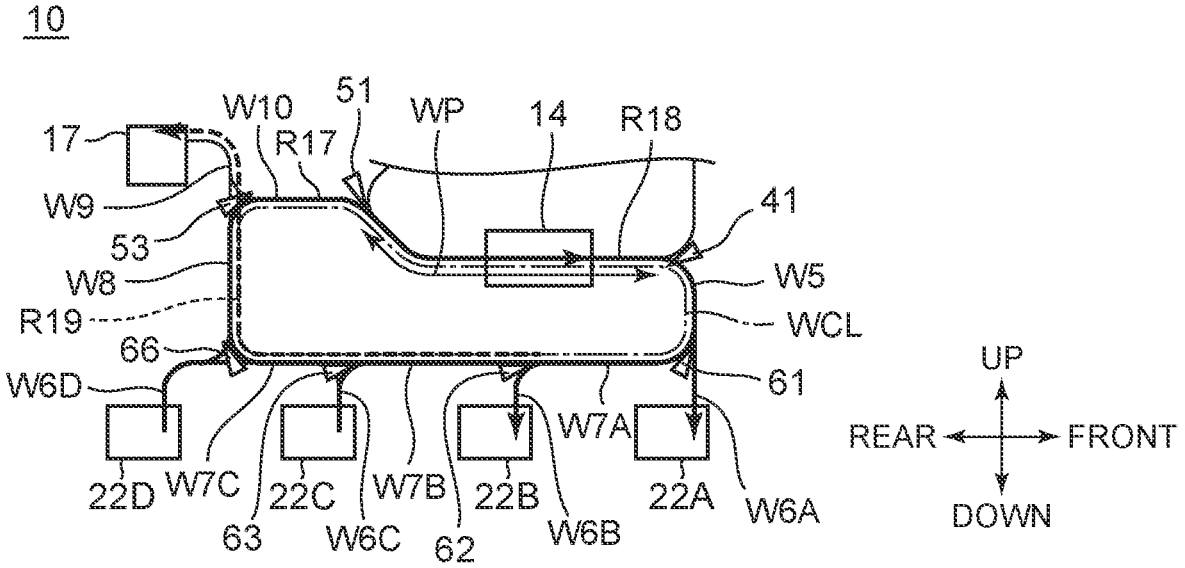
FIG. 10 is a schematic view illustrating a conveyance route of banknotes in a forward banknote movement process.

Subsequently, as illustrated by an arrow direction R17 in FIG. 10, the banknote deposit/withdrawal device 10 conveys banknotes along the conveyance path W6 (W6C or W6D), the conveyance path W7C, the conveyance path W8 and the main conveyance path WP, thereby classifying the banknotes when passing through the classification section 14. Here, the banknote controller 11 identifies a traveling state based on the classification result, and thereby the banknote controller 11 determines the banknote storage boxes 22 as a conveyance destination of normal banknotes, while the banknote controller 11 determines the reject box 17 as a conveyance destination of reject banknotes having a problem in a traveling state.

As illustrated by an arrow direction R18, the banknote deposit/withdrawal device 10 conveys the normal banknotes along the main conveyance path WP, the conveyance path W5, the conveyance path W7A, and the conveyance path W6 (W6A or W6B) to the banknote storage box (22A or 22B) as the movement destination. Further, the banknote deposit/withdrawal device 10 conveys the reject banknotes to the switching unit 62 in the arrow direction R18, and then conveys the reject banknotes along the part of conveyance path W7, the conveyance path W8 and the conveyance path W9 as illustrated by an arrow direction R19, and the reject banknotes are stored in the reject box 17.

In a case where the banknote storage box 22C is the movement source in the banknote deposit/withdrawal device 10, a conveyance route illustrated by the arrow direction R17 and a conveyance route illustrated by the arrow direction R19 are overlapped in the conveyance path W8 and the conveyance path W7C. When the banknote is identified as the reject banknote, the banknote deposit/withdrawal device 10 first suspends the feeding of a new banknote from the banknote storage box 22C or 22D as the movement source, and then conveys the reject banknote to the reject box 17 along the arrow direction R19. After that, the feeding of the banknotes from the banknote storage box 22C or 22D as the movement source is resumed.

In the above case, when a reject banknote is detected, the banknote deposit/withdrawal device 10 conveys banknotes that have been fed out from the banknote storage box 22C, or another storage box, but have not reached the classification section 14, together with the reject banknote, to the reject box 17. By way of example, the banknotes that have been fed out from the banknote storage box 22C or another storage box, but that have not reached the classification section 14, may be normal. Once the reject banknote and other banknotes that have been fed out from the banknote storage box 22*c* or another storage box have been conveyed to the reject box 17, the banknote deposit/withdrawal device 10 resumes the feeding of a new banknote from the banknote storage box 22C or another storage box.

4. Configuration of the Switching Unit

Figure 11:
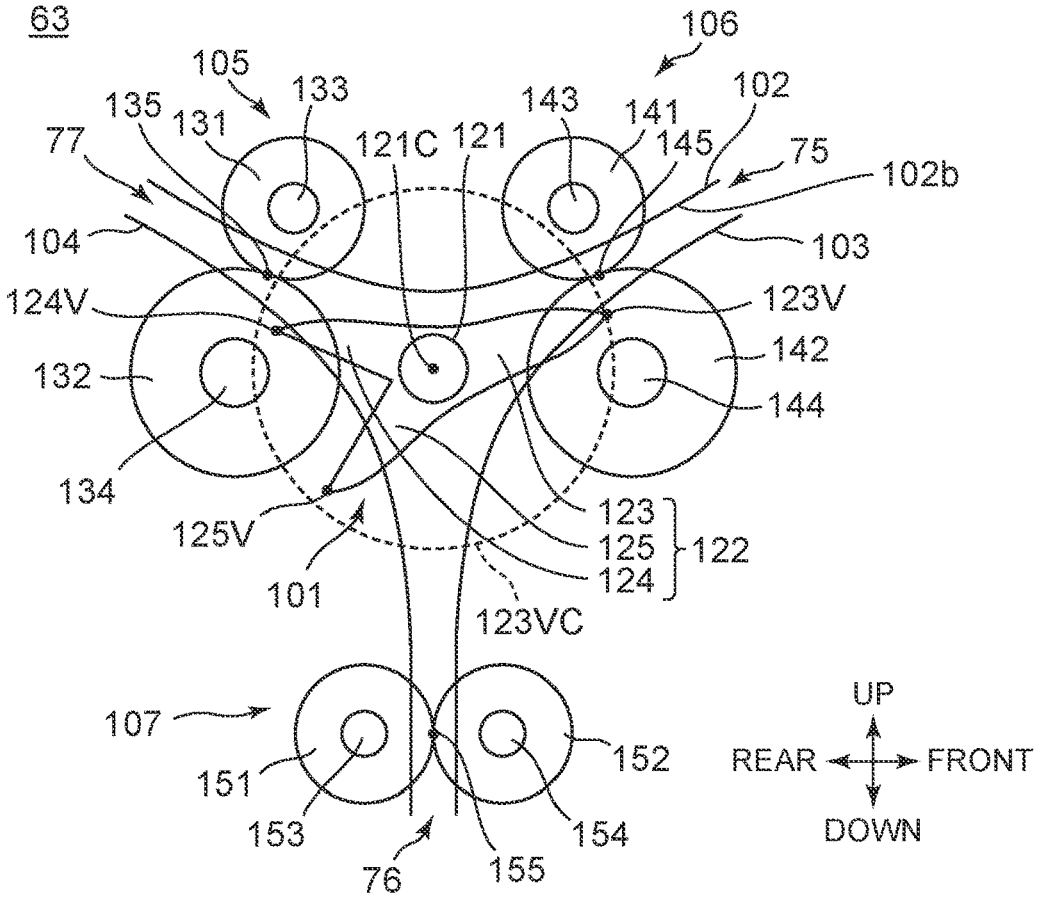
FIG. 11 is a schematic view illustrating a configuration of a switching unit.

Next, a detailed configuration of the switching unit 63 of the lower conveyance section 21 (FIG. 5) will be described. FIG. 11 is a schematic view of the switching unit 63 as viewed from the left side, and illustrates a part of three conveyance guides 102, 103 and 104 disposed around a blade 101 and three pairs of conveyance rollers 105, 106 and 107.

4-1. Configuration of the Blade

The blade 101 is configured by one blade center axis 121 and a plurality of blade plates 122. The blade center axis 121 is formed in a cylindrical shape extending in the left-right direction, and is drawn as a circle centered on the blade center point 121C in FIG. 11. Each blade plate 122 is a wedge shape ("V"-shape) as viewed from the left side, and is formed in a thin plate shape in the left-right direction. As illustrated the perspective view in the FIG. 12, the blade center axis 121 penetrates each blade plate 122 in the left-right direction, and the blade 101 is formed a gap between the blade plates 122.

In the blade 101, the blade center axis 121 is rotatably supported by a predetermined bearing (not illustrated in the drawings), and a driving force is transmitted to the blade center axis 121 from a predetermined actuator (not illustrated in the drawings). Therefore, in the basis of the control of the banknote controller 11 (FIG. 2), the attitude or posture of the blade 101 is changed by integrally rotating the blade center axis 121 and each blade plate 122 around the blade center point 121C, and thereby a posture after the rotation can be maintained. As will be described later, the blade plate 122 causes an oblique part of a wedge shape ("V"-shape) to function in the same manner as a guide face of a conveyance guide, thereby guiding the banknote.

The blade plate 122 has one long blade portion 123 and two short blade portions 124 and 125 which are relatively shorter than the long blade portion 123. The long blade portion 123 is formed on one side of the blade center axis 121, for example, on the front side in FIG. 11, and the two short blade portions 124 and 125 are formed vertically on the opposite side of the long blade portion across the blade center axis 121, for example, in the rear side of FIG. 11.

Figure 13:
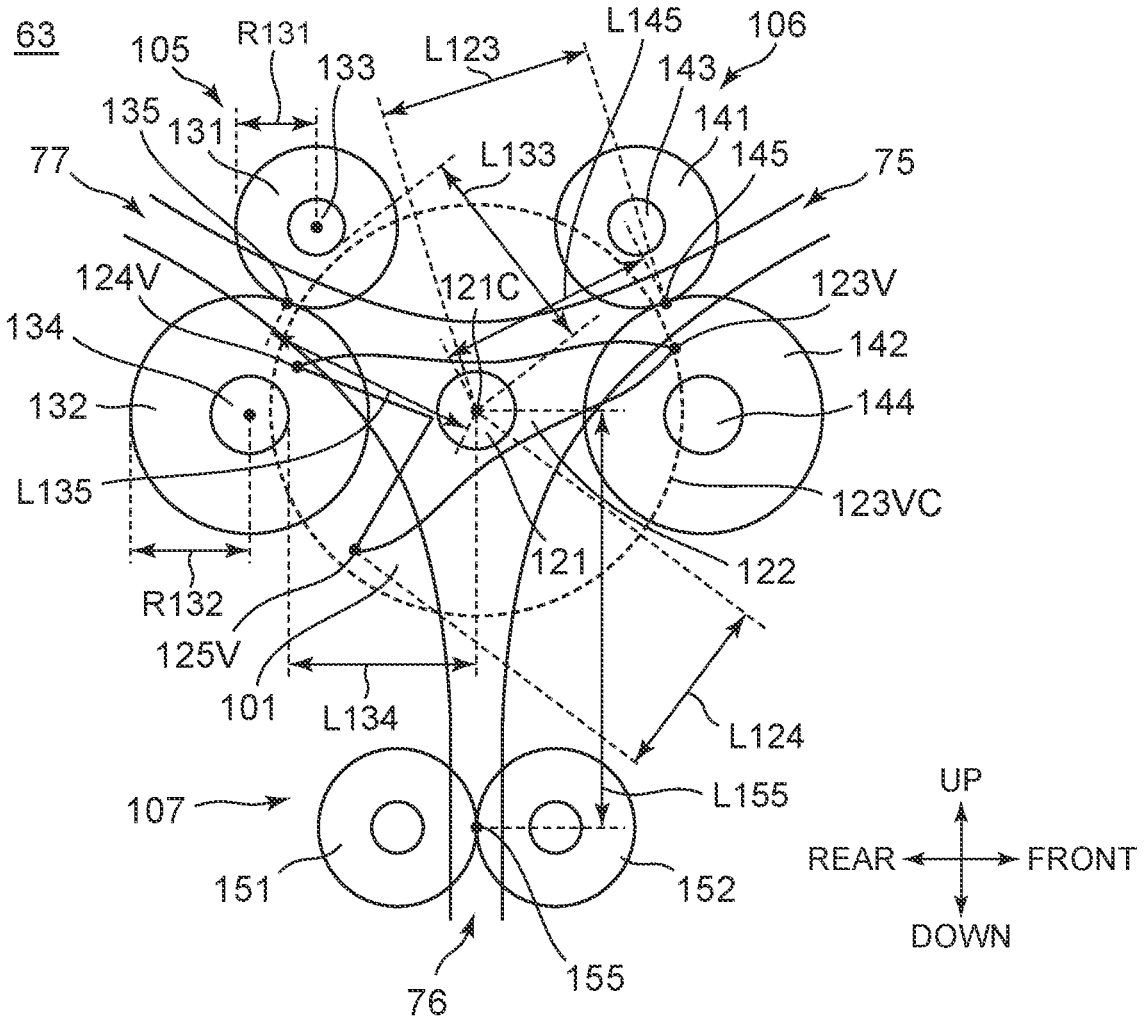
FIG. 13 is a schematic view illustrating a length of each part in the switching unit.

Here, for ease of explanation, as illustrated in FIG. 13, an end point farthest from the blade center point 121C in the long blade portion 123 is defined as a long blade end point 123V, and a distance from the blade center point 121C to the long blade end point 123V is defined as a long blade end distance L123. The blade 101 has a substantially line-symmetric shape with respect to a virtual line (not illustrated in the drawings) connecting the blade center point 121C and the long blade end point 123V.

An end point farthest from the blade center point 121C in the short blade portion 124 is defined as a short blade end point 124V, and a distance from the blade center point 121C to the short blade end point 124V is defined as a short blade end distance L124. Further, an end point from farthest from the blade center point 121C in the short blade portion 125 is defined as a short blade end portion 125V. A distance from the blade center point 121C to the short blade end point 125V is defined as a short blade end distance L124 in the same manner as the short blade portion 124.

In addition, the blade plate 122 is configured such that the short blade end distance L124 is shorter than the long blade end distance L123. FIG. 11 shows a virtual trajectory 123VC representing a position of the long blade end point 123V as the blade 101 rotates around the blade center point 121C. The short blade end point 124V is located inside the long blade end trajectory circle 123VC.

4-2. Configuration of the Conveyance Guide

Figure 12:
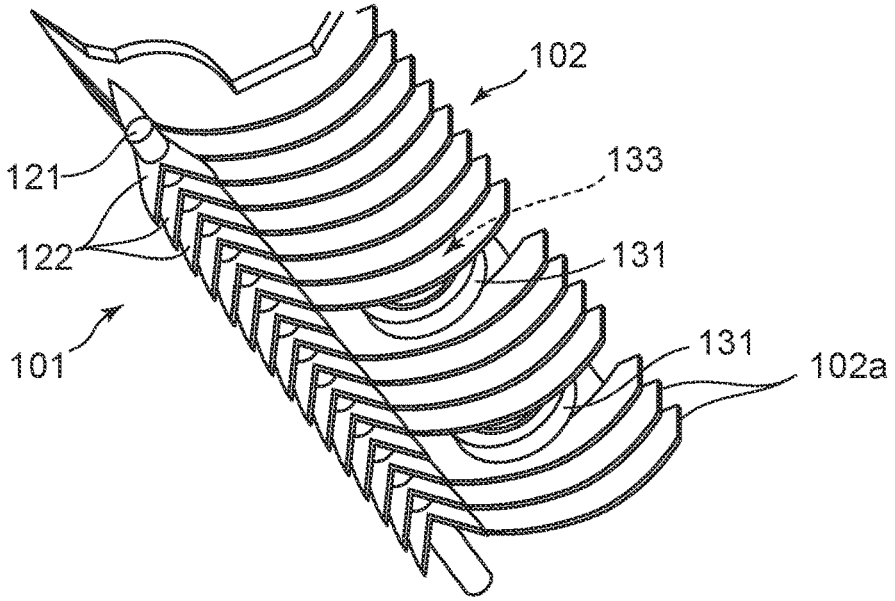
FIG. 12 is a schematic perspective view illustrating a blade, conveyance guides and rollers.

The conveyance guide 102 (FIG. 11) forms an upper part of the conveyance path 75 located in the front side and an upper part of the conveyance path 77 located in rear side in the upper side of the blade center axis 121. A lower face of conveyance guide 102 (hereinafter, also referred to as a guide face) is formed in a flat or curve shape substantially along the front-rear direction, thereby guiding the sheet surface of the banknote along the conveyance path 75 or the conveyance path 77. As illustrated in FIG. 12, for example, the conveyance guide 102 is appropriately formed with holes and depressions of a predetermined shape in order to avoid interference with each blade plate 122 of the blade 101, the pair of rollers 105 described later, and the like.

The conveyance path 75 is formed in the vicinity of the blade 101 to direct banknotes toward the blade center point 121C and is inclined such that the rear side is lower than the front side. The conveyance path 77 is formed in the vicinity of the blade 101 to direct banknotes toward the blade center point 121C, and is inclined such that the front side is lower than the rear side. An angle that is made by the conveyance path 75 and the conveyance path 77 that are next to each other is approximately 120°.

The conveyance guide 103 has a configuration in which the conveyance guide 102 is rotated approximately 120° clockwise around the blade center point 121C, as viewed from the left side. Further, the conveyance guide 104 has a configuration in which the conveyance guide 102 is rotated approximately 120° counterclockwise around the blade center point 121C, as viewed from the left side.

4-3. Configuration of the Pair of Conveyance Rollers

The pair of conveyance rollers 105, referred to herein as a first pair of conveyance rollers, is located slightly upward on the rearward side of the blade center point 121C, and is made up of a pair of rollers including an upper roller 131 located on the upper side of the conveyance path 77, referred to herein as the first conveyance path, and a lower roller 132 located in the lower side of the conveyance path 77. The upper roller 131 and the lower roller 132 face each other across the conveyance path 77. The upper roller 131, referred to herein as an opposing roller, is formed in a circular disk shape with a plate face facing in the left-right direction, and it has a radius R131 (FIG. 13). The upper roller 131 is penetrated in the left-right direction at the center of the circular disk by an upper roller center axis 133, referred to herein as an opposing roller center axis.

As illustrated in FIG. 12, the guide part 102 (as well as the guide part 103 and the guide part 104, not shown in FIG. 12) are made up of an array of guide plates 102*a* spaced apart from each other. The upper rollers are respectively inserted between two adjacent guide plates 102*a* at two locations separated in the left-right direction with the respect to the one upper roller center axis 133. Although the upper roller center axis 133 (FIG. 11) is located above a guide face 102*b* of the conveyance guide 102, a part of each upper roller 131 is exposed below the guide face 102*b* through holes having a predetermined shape formed on the conveyance guide 102. That is, the part of each upper roller 131 is exposed in the conveyance path 77.

The upper roller center axis 133 is formed in a cylindrical shape extending in the left-right direction, and is rotatably supported by a bearing (not illustrated in the drawings), in the same manner as the blade center axis 121. The upper roller center axis 133 can integrally rotate clockwise or counterclockwise with the upper rollers 131 by transmitting a driving force from a motor (not illustrated in the drawings).

The lower roller 132, referred to herein as a third side roller, is formed in a circular disk with a plate face facing in the left-right direction in the same manner as the upper roller 131, and is penetrated by a lower roller center axis 134 as a third side roller center axis at the center of the circular disk (that is, at the center of rotation). A length R132 (FIG. 13), which is a radius of the lower roller 132, is longer than the length R131, which is the radius of the upper roller 131. Like the upper roller 131, the pair of conveyance rollers 105 includes two lower rollers that are respectively inserted between adjacent guide plates 102*a* of the guide part 102 with the respect to the lower roller center axis 134 at two locations facing the two upper rollers 131. Further, the lower roller center axis 134 is biased toward the upper roller center axis 133 by a biasing member (not illustrated in the drawings).

With this configuration, a circumferential side face of each lower roller 132 contacts a circumferential side face of each upper roller 131 at a holding point 135 which is a center point between the guide face of the conveyance guide 102 and the guide face of the conveyance guide 104. The pair of conveyance rollers 105 may hold a banknote in the conveyance path 77 by the upper rollers 131 and the lower rollers 132. Further, the pair of conveyance rollers 105 can transmit a driving force with respect to the banknote that is held by the upper rollers 131 and the lower rollers 132 by providing a rotation force to the upper roller center axis 133, and thereby the banknote can be advanced the lower frontward direction or the upper rearward direction. For ease of explanation, a distance from the blade center point 121C to the holding point 135 is hereinafter referred to as a center holding distance L135 (FIG. 13).

The switching unit 63 (FIG. 13) is configured such that a distance from the blade center point 121C to the circumferential side face of the upper roller center axis 133 (hereinafter, referred to as an upper roller center axis distance L133) is shorter than a distance from the blade center point 121C to the circumferential side face of the lower roller center axis 134 (hereinafter, referred to as a lower roller center axis distance L134). In other words, the switching unit 63 is configured such that the lower rollers 132 are disposed closer to the blade center point 121C than the upper rollers 131. Hereinafter, for ease of explanation, the upper roller center axis distance L133 and the lower roller center axis distance L134 are respectively referred to as an opposing roller center axis distance and the third side roller center axis distance.

The switching unit 63 is configured such that the long blade end distance L123 in the blade 101 is shorter than the upper roller center axis distance L133 and longer than the lower roller center axis distance L134. Further, the switching unit 63 is configured such that the short blade end distance L124 is shorter than the lower roller center axis distance L134. That is, the switching unit 63 is configured such that the upper roller center axis 133 is outside the long blade end trajectory circle 123VC, and at least a part of the lower roller center axis 134 is inside the long blade end trajectory circle 123VC.

A pair of conveyance rollers 106, referred to herein as a second pair of conveyance rollers, includes two upper rollers 141, two lower rollers 142, an upper roller center axis 143, a lower roller center axis 144 and a holding point 145 corresponding to the upper rollers 131, the lower rollers 132, the upper roller center axis 133, the lower roller center axis 134 and the holding point 135 in the pair of conveyance rollers 105, respectively. The pair of conveyance rollers 106 is substantially symmetrical with the pair of conveyance rollers 105 around the blade center axis 121C. That is, the pair of conveyance rollers 106 is configured such that the upper rollers 141 and the lower rollers 142 are respectively disposed above and below the conveyance path 75, referred to herein as a second conveyance path.

The pair of conveyance rollers 106 (FIG. 13) is configured such that a distance from the blade center point 121C to the circumferential side face of the upper roller center axis 143 is substantially equal to the upper roller center axis distance L133 of the pair of conveyance rollers 105. Further, the pair of conveyance rollers 106 is configured such that a distance from the blade center point 121C to the circumferential side face of the lower roller center axis 144 is substantially equal to the lower roller center axis distance L134 of the pair of conveyance rollers 105. Further, the pair of conveyance rollers 106 is configured such that the center holding distance L145 which is distance from the blade center point 121C to the holding point 145, is equal to the center holding distance L135 in the pair of conveyance rollers 105.

The pair of conveyance rollers 107 (FIG. 11), referred to herein as a third pair of conveyance rollers, is located below the blade center point 121C, and is made up of a rear roller 151 located in the rear side of the conveyance path 76, referred to herein as a third conveyance path, and a front roller 152 located in the front side of the conveyance path 76. Each of the rear roller 151 and the front roller 152 is formed in a circular disk shape in the same manner as the upper roller 131 of the pair of conveyance rollers 105. Further, unlike the pair of conveyance rollers 105 and the pair of conveyance rollers 106, the pair of conveyance rollers 107 is configured such that radii of the rear roller 151 and the front roller 152 are substantially equal to each other.

A rear roller center axis 153 penetrates through the rear roller 151 at the center portion thereof. The rear roller center axis 153 is formed in a cylindrical shape extending in the left-right direction, and is rotatably supported by a bearing (not illustrated in the drawings), in the same manner as the blade center axis 121. A driving force is applied to the rear roller center axis 153 by a motor (not illustrated in the drawings), thereby causing the rear roller to rotate clockwise or counterclockwise.

A front roller center axis 154 penetrates through the front roller 152 at the center portion thereof. The front roller center axis 154 is formed in a cylindrical shape extending in the left-right direction in the same manner as the lower roller center axis 134 of the pair of conveyance rollers 105, and biased toward the rear roller center axis 153 by a biasing member (not illustrated in the drawings).

With this configuration, the circumferential side face of the front roller 152 is contact with the circumferential side face of the rear roller 151 at a holding point 155, which is a substantially center point between the guide face of the conveyance guide 102 and the guide face of the conveyance guide 103. Thereby, the pair of conveyance rollers 107 may hold the banknote in the conveyance path 76 by the upper roller 151 and the lower roller 152. Further, the pair of conveyance rollers 107 can transmit a driving force to the rear roller 151 to drive the front roller 152, and thereby the banknote can be advanced in the lower frontward direction or the upper rearward direction.

The switching unit 63 (FIG. 13) is configured such that a distance from the blade center point 121C to the rear roller center axis 153 and the blade center point 121C to the front roller center axis 154 are longer than the upper roller center axis distance L133, which is a distance from the blade center point 121C to the upper roller center axis 133. Accordingly, the switching unit 63 is configured such that a center holding distance L155 which is a distance from the blade center point 121C to the holding point 155 is longer than the center holding distance L135 in the pair of conveyance rollers 105 and the center holding distance L145 in the pair of conveyance rollers 106.

4-4. Rotation of Blade and Formation of Conveyance Path

Figure 14:
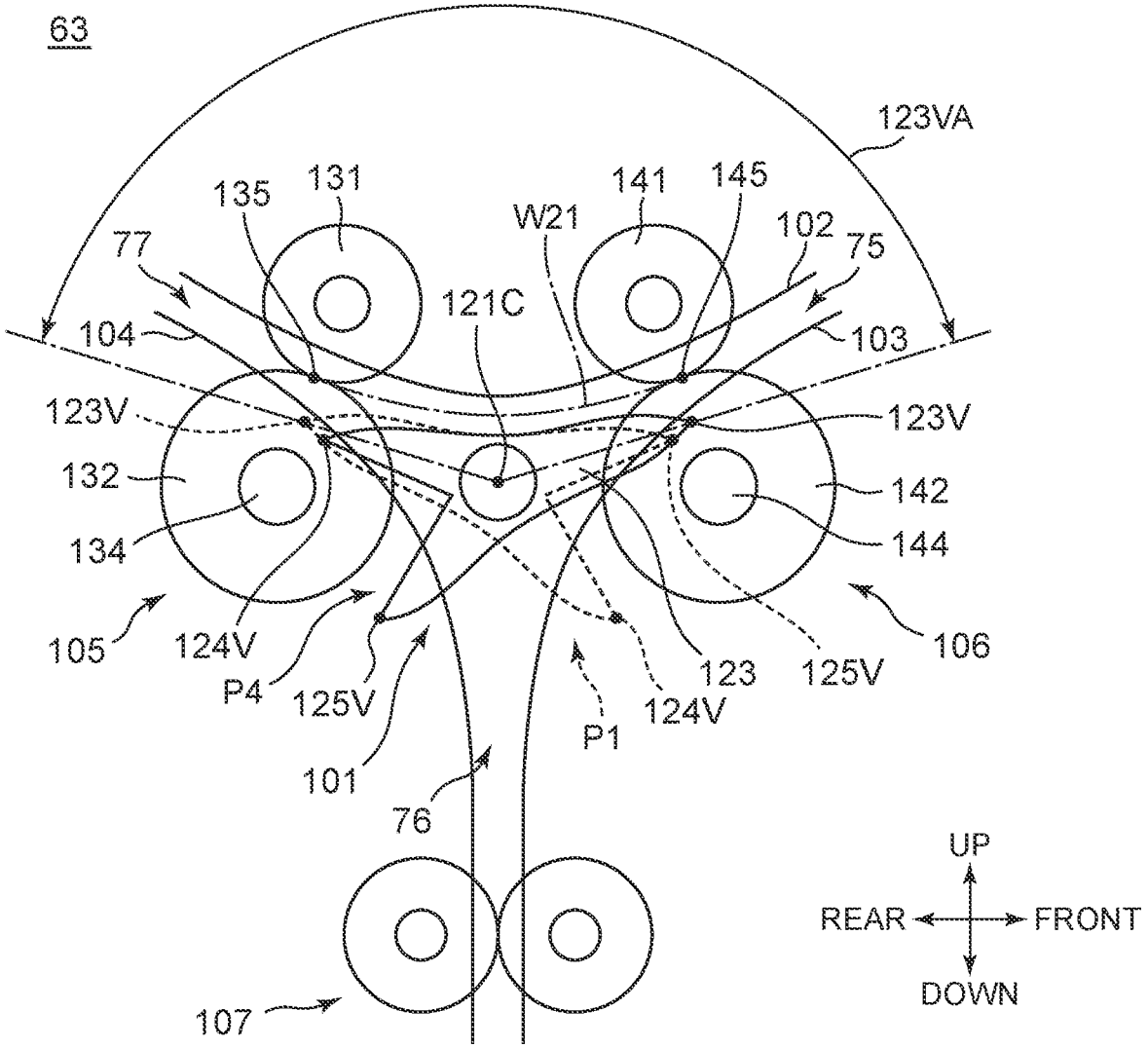
FIG. 14 is a schematic view illustrating a conveyance route formed by a posture of the blade.

Due to the relationship between the distance and position of each part, in the switching unit 63, the rotation range of the blade 101 is limited by the lower roller center axis 134 and the lower roller center axis 144 as illustrated in FIG. 14. More specifically, the switching unit 63 is configured such that the long blade end point 123V of the long blade portion 123 is limited to position within the range of about 150 to 160° from the lower roller center axis 134 of the pair of conveyance rollers 105 to the lower roller center axis 144 of the pair of conveyance rollers 106 clockwise around the blade center point 121C. For ease of explanation, the rotation range is hereinafter referred to as a blade rotation range 123VA.

In FIG. 14, a posture in which the long blade end point 123V of the blade 101 is pointed toward the rearward side, as illustrated by the broken line, is referred to as a blade first posture P1. In the blade first posture P1, the blade 101 is configured such that the long blade end point 123V is located on the backward side of the guide face of the conveyance guide 104, or behind the conveyance guide 104, when viewed in a side view (i.e. the view of FIG. 14). Further, the blade 101 is configured such that the short blade end point 125V is located behind the conveyance guide 103, as viewed in the side view, in the blade first posture P1. Accordingly, the switching unit 63 forms a continuous substantially curved face facing the conveyance guide 102 by connecting an upper portion of the conveyance guide 104, a side face of a side of the short blade portion 125 in the blade 101 and an upper portion of the conveyance guide 103, and thereby a conveyance route W21 connecting the holding point 135 and the holding point 145 can be formed. Here, "substantially curved" means having a generally curved surface, with a single point where the edge of the blade 101 overlaps the edge of the conveyance guide 104 to form an obtuse angle.

In FIG. 14, a posture in which the long blade end point 123V of the blade 101 is pointed toward the frontward side, as illustrated by the solid line, is referred to as a blade fourth posture P4. In the blade fourth posture P4, the blade 101 is configured such that the long blade end point 123V is located behind the conveyance guide 103, as viewed from a side view (i.e. the view in FIG. 14), and the short blade end point 124V is located behind the conveyance guide 104, as viewed from the side view. Accordingly, the switching unit 63 forms a continuous substantially curved face facing the conveyance guide 102 by connecting an upper portion of the conveyance guide 104, a side face of a side of the short blade portion 124 in the blade 101, and an upper portion of the conveyance guide 103. Here, "substantially curved" means having a generally curved surface, with a single point where the edge of the blade 101 overlaps the edge of the conveyance guide 104 to form an obtuse angle. The switching unit 63 can also form the conveyance route W21 connecting the holding point 135 and the holding point 145 in this case as well. In other words, when rotating between the blade first posture P1 and the blade fourth posture P4, the blade rotation range 123 VA is set in a range such that the long blade end point 123V of the long blade portion 123 passes through the conveyance path 75 and the conveyance path 77 but does not pass through the conveyance path 76, and does not pass below the circumferential side faces of the lower roller center axis 134 and the lower roller center axis 144.

Figure 15:
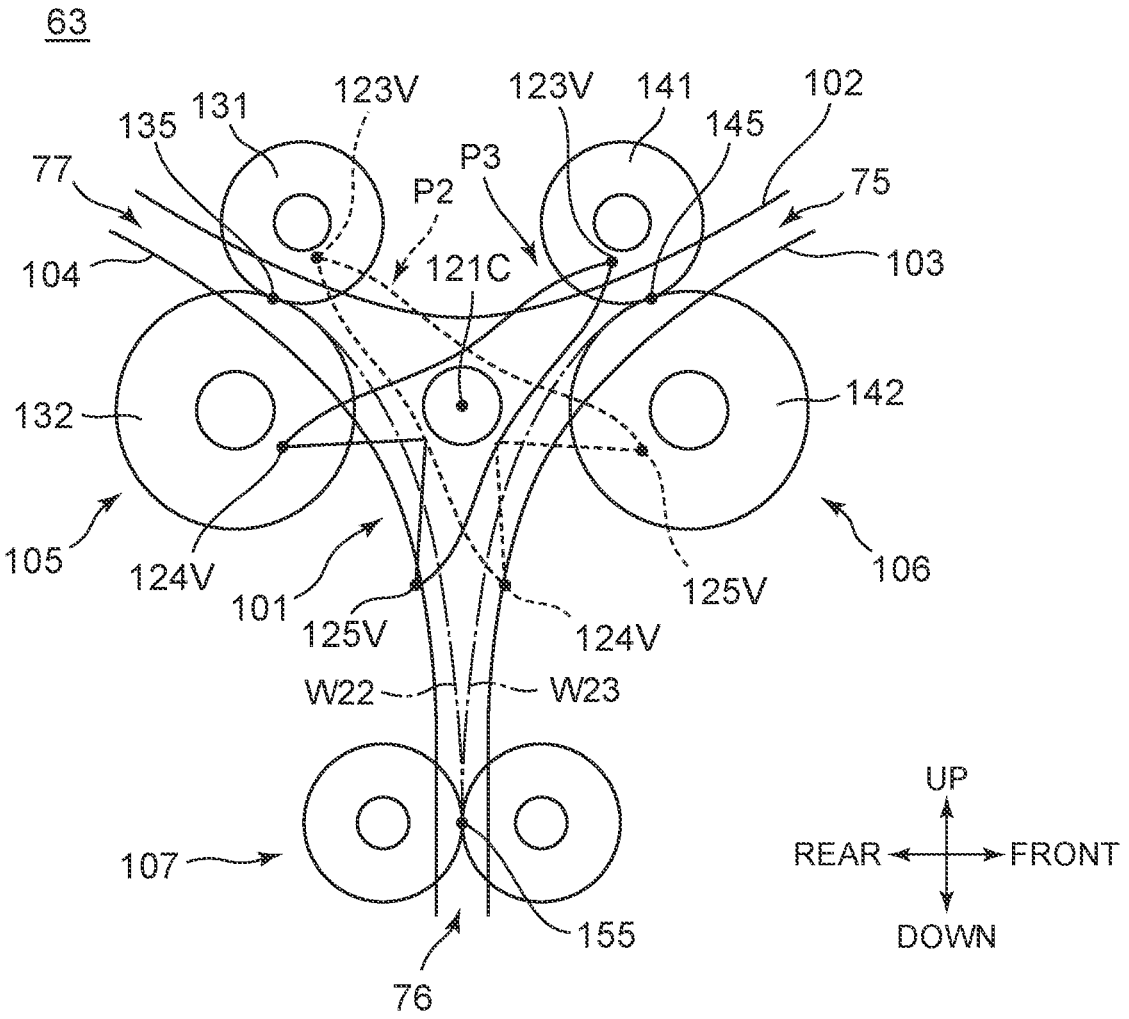
FIG. 15 is a schematic view illustrating a conveyance route formed by a posture of the blade.

In the switching unit 63, the blade 101 is rotated clockwise about 20 to 30° around the blade center point 121C from the blade first posture P1 (FIG. 14), thereby positioning the blade 101 in a blade second posture P2 as illustrated by a broken line in FIG. 15. In the blade second posture P2, the blade 101 is configured such that the long blade end point 123V is located inside the conveyance guide 102 behind the blade center point 121C, and the short blade end point 124V is located behind the conveyance guide 103, as seen in a side view (i.e. the view of FIG. 14). Accordingly, the switching unit 63 forms a continuous substantially curved face facing the conveyance guide 104 by connecting a rear portion of the conveyance guide 102, a side face of a side of the short blade portion 124 in the blade 101, and a lower portion of the conveyance guide 103, and thereby a conveyance route W22 connecting the holding point 135 and the holding point 155 can be formed.

In the switching unit 63, the blade 101 is rotated counterclockwise about 20 to 30° around the blade center point 121C from the blade first posture P1 (FIG. 14), thereby resulting in a blade third posture P3 as illustrated by a solid line in FIG. 15. In the blade third posture P3, the blade 101 is configured such that the long blade end point 123V is located behind the conveyance guide 102 in a side view at the front side of the blade center point 121C, and the short blade end point 125V is located behind the conveyance guide 104 in the side view. Accordingly, the switching unit 63 forms a continuous substantially curved face facing the conveyance guide 103 by connecting a front portion of the conveyance guide 102, a side face of a side of the short blade portion 125 in the blade 101, and a lower portion of the conveyance guide 104, and thereby a conveyance route W23 connecting the holding point 145 and the holding point 155 can be formed.

In the switching unit 63, for example, the length between the holding points along each formed conveyance path, such as the length between the holding point 135 and the holding point 155 along the conveyance route W22, is longer than the length of the banknote in a conveyance direction, that is, a short side length of the banknote. In the switching unit 63, regardless of which the conveyance path W21, the conveyance path W22, and the conveyance path W23 is formed, the banknote can be handed off and conveyed between two pair of conveyance rollers, such as between the pair of conveyance rollers 105 and the pair of conveyance rollers 106.

As described above, the switching unit 63 switches the blade 101 to one of the three conveyance routes such as the conveyance route W21, the conveyance route W22, or the conveyance route W23 by switching the blade 101 to any one of the blade first posture P1, the second blade posture P2, the blade third posture P3 and the blade fourth posture P4. Thereby, two of the conveyance paths among the conveyance path 75, the conveyance path 76 and the conveyance path 77 can be connected. Then, the switching unit 63 can advance the banknote along each formed conveyance route by appropriately rotating each of the pair of conveyance rollers 105, the pair of conveyance rollers 106 and the pair of conveyance rollers 107.

For example, in a deposit process (FIG. 7A), the banknote deposit/withdrawal device 10 classifies each banknote in the classification section 14 while sequentially conveying a plurality of deposited banknotes at high speed at short intervals, thereby determining a conveyance destination of each banknote in the banknote controller 11 based on the obtained classification result. For example, in the banknote deposit/withdrawal device 10, the temporary holding switching unit 52 needs to switch each conveyance route during an extremely short time by changing the angle of the blade at high speed for each banknote to be conveyed. Hereinafter, such an operation in each switching unit is referred to as a high-speed switching operation.

For example, when the banknote deposit/withdrawal device 10 completes the deposit process (FIG. 7A) and starts the storage process (FIG. 7B), the upper front switching unit 41 switches the conveyance route. After that, the formed conveyance route is not switched and is maintained during the storage process. Specifically, the upper front switching unit 41 may switch the conveyance route of the banknotes during a relatively long time from the completion of the deposit process to the start of the storage process. Hereinafter, such an operation in each switching unit is referred to as a low-speed switching operation.

In the switching unit 63 provided in the lower conveyance section 21 (FIG. 5), for example, in the storage process (FIG. 7B), it is necessary to perform a high-speed switching operation such that a plurality of banknotes to be conveyed at a high speed from the conveyance path 75, located on the frontward side of the switching unit 63, are advanced to the conveyance path 76, located on the downward side, or the conveyance path 77, located on the rearward side, in accordance with the conveyance destination of the banknotes (that is, the banknote storage box 22 in which the banknotes are to be stored). That is, the switching unit 63 needs to quickly switch between a state in which the conveyance route W21 is formed by switching the blade 101 to the blade fourth posture P4 (FIG. 14) and a state in which the conveyance route W23 is formed by switching the blade 101 to the blade third posture P3 (FIG. 15). In this case, in the switching unit 63, since the rotation angle of the blade 101 is relatively narrow, about 20 to 30°, it is possible to switch the conveyance route W21 and the conveyance route W23 at a high speed.

For example, when a reject banknote is identified in the forward banknote movement process (FIG. 10), the switching unit 63 switches the conveyance route of the banknotes by the high-speed switching operation such that the banknotes are advanced from the conveyance path 76, located on the downward side of the switching unit 63, to the conveyance path 77, located on the rearward side, or the banknotes are advanced from the conveyance path 75, located on the frontward side, to the conveyance path 77, located in the rearward side. That is, the switching unit 63 needs to quickly switch between a state in which the conveyance route W21 is formed by switching the blade 101 to the blade first posture P1 (FIG. 14) and a state in which the conveyance route W22 is formed by switching the blade 101 to the blade second posture P2 (FIG. 15). In this case, in the switching unit 63, since the rotation angle of the blade 101 is relatively narrow, about 20 to 30°, it is possible to switch the conveyance route W21 and the conveyance route W22 at a high speed.

4-5. Configuration of the Hand-Off Unit

Figure 16A:
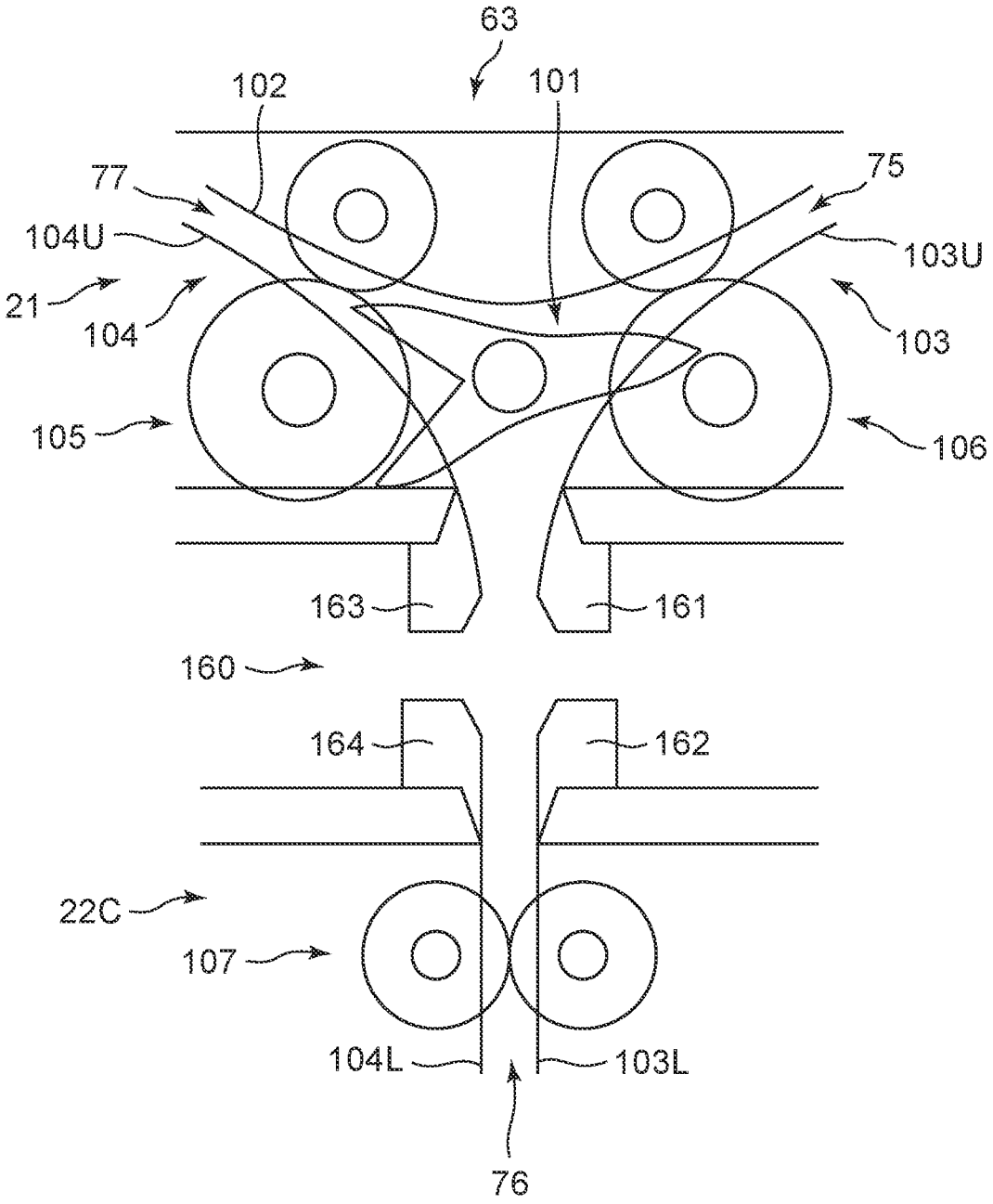
FIG. 16A is a schematic view illustrating a configuration of a hand-off unit.

As illustrated in FIG. 16A corresponding to FIG. 11, the actual switching unit 62 is configured such that the blade 101, the pair of conveyance rollers 105 and the pair of conveyance rollers 106 are installed on a side of the lower conveyance section 21 (FIG. 5), the pair of conveyance rollers 107 is installed on a side of the banknote storage box 22C, and a hand-off unit 160 is disposed between the blade 101 and the pair of conveyance rollers 107.

The conveyance guide 103 is divided into an upper conveyance guide 103U and a lower conveyance guide 103L that is slightly below the blade 101. The conveyance guide 103 is provided with an upper comb-tooth portion 161 at a lower end of the upper conveyance guide 103U, and a lower comb-tooth portion 162 at a lower conveyance guide 103L. The conveyance guide 104 is configured to be substantially symmetrical with the conveyance guide 103, and divided into an upper conveyance guide 104U and a lower conveyance guide 104L slightly below the blade 101. The conveyance guide 104 is provided with an upper comb-tooth portion 163 at a lower end of the upper conveyance guide 104U, and a lower comb-tooth portion 164 at a lower end of the lower conveyance guide 104L. For ease of explanation, the upper conveyance guide 103U and the upper conveyance guide 104U are also referred to as a blade side conveyance guide, and the lower conveyance guide 103L and the lower conveyance guide 104L are also referred to as a third pair of conveyance rollers side conveyance guide.

Figure 16B:
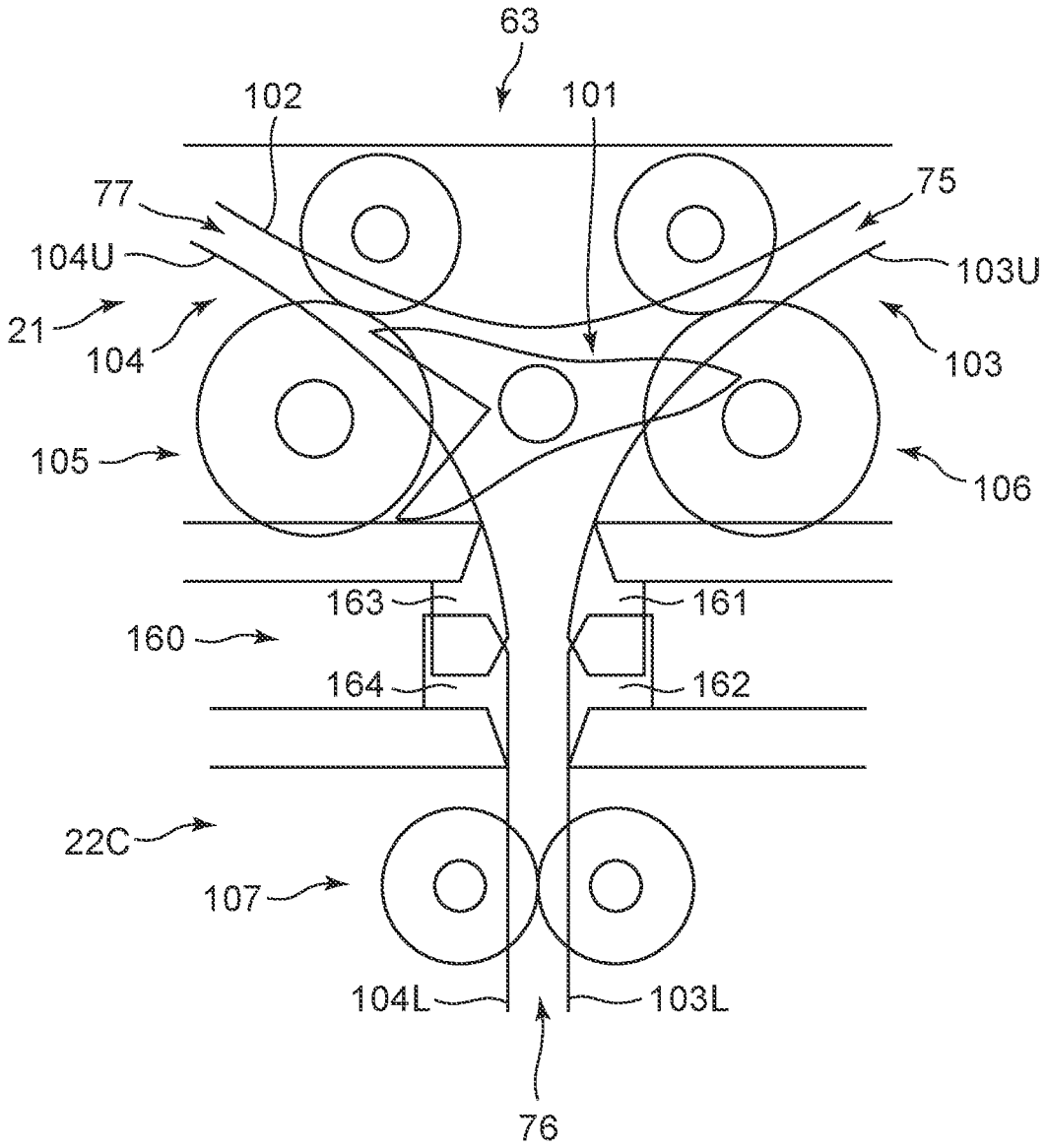
FIG. 16B is a schematic view illustrating a configuration of the hand-off unit.

The upper comb-tooth portion 161 has what is referred to as a comb-tooth shape, and has a shape in which a plurality of relatively small cuboids are aligned at predetermined intervals along the left-right direction (that is, a width direction orthogonal to the conveyance direction of the banknote, and a direction orthogonal to the sheet surface in FIG. 16A and FIG. 16B) as a whole. Each cuboid is configured such that a length of each cuboid in the left-right direction is a shorter than the length of the conveyed banknote in the left-right direction (that is, a length of a long side of the banknote). The gap between the cuboids adjacent to each other in the upper comb-tooth portion 161 is slightly longer than a length of the cuboids in the left-right direction. A portion of each cuboid in a vicinity of a lower end of the guide face is cut off obliquely when viewed from the left-right direction to form a chamfered portion.

The lower comb-tooth portion 162 is substantially vertically symmetrical with the upper comb-tooth portion 161, but the position of each cuboid in the left-right direction is a position corresponding to each gap between the cuboids in the upper comb-tooth portion 161. In other words, each cuboid of the lower comb-tooth portion 162 is disposed at a position complementary with respect to each cuboid of the upper comb-tooth portion 161. In each cuboid of the lower comb-tooth portion 162, a vicinity of an upper end of the guide face (that is, a rear face) is cut off obliquely when viewed in the left-right direction.

The upper comb-tooth portion 163 and the lower comb-tooth portion 164 are substantially symmetrical with the upper comb-tooth portion 161 and the lower comb-tooth portion 162, respectively.

With this configuration, the lower conveyance section 21 closes an upper side of the lower frame 20 with the banknote storage box 22C loaded into the loading space of the lower frame 20 (FIG. 5), and thereby the conveyance guide 103 is interlocked by the upper comb-tooth portion 161 and the lower tooth portion 162, as illustrated in FIG. 16B. More specifically, the conveyance guide 103 causes each cuboid of the upper comb-tooth portion 161 to enter into each gap of the lower comb-tooth portion 162, and causes each cuboid of the lower comb-tooth portion 162 to enter into each gap of the upper comb-tooth portion 161. Hereinafter, the above state is also referred to as a connection state.

Since the upper comb-tooth portion 161 and the lower comb-tooth portion 162 substantially align the positions of their rear faces in the front-rear direction, it is possible to form a substantially smooth continuous guide face as a whole at the connection point of the upper comb-tooth portion 161 and the lower comb-tooth portion 162. Similarly, the conveyance guide 104 can form a substantially smoothly continuous guide face as a whole, similarly to the conveyance guide 103 by causing the upper comb-tooth portion 163 and the lower comb-tooth portion 164 interlock with each other. Thereby, in the switching unit 63, any of the banknotes conveyed downward or upward along the conveyance path 76 can be smoothly advanced in the connection state (FIG. 16B).

The switching unit 66 of the lower conveyance section 21 (FIG. 5) has a configuration similar to the switching unit 63, but arranged upside-down relative to the switching unit 63. In the switching unit 66, the blade 101, the pair of conveyance rollers 105, and the pair of conveyance rollers 106 are installed on a side of the lower conveyance section 21 of the lower unit 10L, and the pair of conveyance rollers 107 is installed on a side of the upper rear conveyance section 15 (FIG. 4A or FIG. 4B) of the upper unit 10U. The switching unit 66 is also provided with the hand-off unit 160 between a side of the blade 101 in the conveyance guide 103 and the conveyance guide 104 and a side of the pair of conveyance rollers 107.

5. Operation and Effects

In the banknote deposit/withdrawal device 10 of the ATM 1 configured as described above, the switching unit 63 (FIG. 11) of the lower conveyance section 21 (FIG. 5) is configured such that the length R132, which is the length of the radii of the lower roller 132 and the lower roller 142, is longer than the length R131, which is the length of the radii of the upper roller 131 and the upper roller 141. The lower roller center axis distance L134 is shorter than the upper roller center axis distance L133.

By way of comparison, a general three-way switching unit 200 will be described with reference to FIG. 17A and FIG. 17B. The switching unit 200 includes a blade 201, a conveyance guide 202, a conveyance guide 203, a conveyance guide 204, a pair of conveyance rollers 205, a pair of conveyance rollers 206 and a pair of conveyance rollers 207.

The blade 201 is made up of a blade center axis 121 and a blade plate 222. The blade plate 222 includes a long blade portion 123 similar to the switching unit 63, a short blade portion 224 and a short blade portion 225. The short blade portion 224 and the short blade portion 225 are configured such that a distance from a blade center point 221C to a short blade end point 224V and from the blade center point 221C to a short blade end point 225V are equal to a long blade end distance L123. Therefore, the switching unit 200 is configured such that the short blade end point 224V and the short blade end point 225V are located on long blade end trajectory circle 123VC.

The pair of conveyance rollers 205 includes the upper roller 131 and the upper roller center axis 133, and a lower roller 232 and a lower roller center axis 234. In the pair of conveyance rollers 205, the upper roller 131 is in contact with the lower roller 232 at a holding point 235. A radius of the lower roller 232 is a length R131 equivalent to a radius of the upper roller 131. A distance from the blade center point 221C to the lower roller center axis 234 is equal to the upper roller center axis distance L133 (FIG. 13), and is longer than the lower roller center axis distance L134 in the switching unit 63.

Therefore, in the switching unit 200, both the upper roller center axis 133 and the lower roller center axis 234 are located outside the long blade end trajectory circle 123VC, and thereby the blade 201 can be freely rotated without limiting the rotation range of the blade 201 by the lower roller center axis 234. On the other hand, in the switching unit 200, a center holding distance L235, which is the distance from the blade center point 221C to the holding point 235, is longer than the center holding distance L135 in switching unit 63.

The switching unit 200 has a configuration in which the pair of conveyance rollers 206 and the pair of conveyance rollers 207 are disposed at positions where the pair of conveyance rollers 205 rotates clockwise about 120° and 240° around the blade center point 221. Therefore, in the switching unit 200, the holding point 235 of the pair of conveyance rollers 205, a holding point 245 of the pair of conveyance rollers 206 and a holding point 255 of the pair of conveyance rollers 207 are all separated by the center holding distance L235 from the blade center point 221C. Here, if the center holding distance L235 of the switching unit 200 is compared with each center holding distance of the switching unit 63, and if it is assumed that the blade center axis 121 of FIG. 17A is identical to the blade center axis 121 of FIG. 11, and if it is further assumed that the sizes of each other element in FIGS. 11 and 17A are proportional in scale to the blade center axis 121, then the center holding distance L235 is larger (longer) than the center holding distance L135 or the center holding distance L145, and the center holding distance L235 is smaller (shorter) than the center holding distance L155.

If the high-speed switching operation described above is performed by the switching unit 200, it is necessary to satisfy some conditions. More specifically, the switching unit 200 needs to set an interval between the conveyance guides to be equal to or longer than a predetermined conveyance path interval t in order to prevent banknotes from being jammed in the conveyance path. Further, the switching unit 200 needs to set a distance from a guide face of each conveyance guide into an inside portion of each conveyance guide to be equal to, or more than, a predetermined blade end point depth 6 in order to prevent banknotes having creases from being caught on any end point of the blade 201 (the long blade end point 123V, the short blade end point 224V, and the short blade end point 225V). Further, in the switching unit 200, when the blade 201 is rotated from one conveyance path to another conveyance path, such as the blade first posture P11 and the blade second posture P12, it is necessary to suppress the rotation angle of the blade 201 to a predetermined blade switching angle θ or less.

In addition, in the switching unit 200, in order to satisfy the constraints such as the conveyance path interval t, the blade end point depth 6 and a blade switching angle θ, the long blade end distance L123 in the blade 201 is limited to be equal to, or more than, a certain value. Specifically, in the switching unit 200, in order to smoothly rotate the blade 201, it is necessary to dispose each roller center axis (the upper roller center axis 133) of each pair of conveyance rollers outside the long blade end trajectory circle 123VC. On the other hand, in the switching unit 200, for example, a distance between the holding point 235 and the holding point 255 along the conveyance route, that is, a roller pitch P which is a distance between the roller center axes along the guide face of the conveyance guide, needs to be shorter than a length of the banknote along the conveyance direction, that is, a length of the short side of the banknote.

As described above, in the switching unit 200, it is necessary to dispose the pair of conveyance rollers 205, the pair of conveyance rollers 206 and the pair of conveyance rollers 207 at positions relatively close to the blade 201, from the viewpoint of reliably handing off banknotes between holding points. Specifically, in the switching unit 200, other components such as the hand-off mechanism for smoothly handing off banknotes between the conveyance guides that can be separated from each other cannot be disposed between the blade 201 and the pair of conveyance rollers 207, and the like. Therefore, design constraints may impair system efficiency.

In contrast, the switching unit 63 (FIG. 11 and FIG. 13) according to the present exemplary embodiment is configured such that the length R132, which is the radius of the lower roller 132, is longer than the length R131, which is the radius of the upper roller 131 in the pair of conveyance rollers 105. In addition, the switching unit 63 is configured such that the lower roller center axis distance L134 based on the blade center point 121C is shorter than the upper roller center axis distance L133 in the pair of conveyance rollers 105.

Figure 17A:
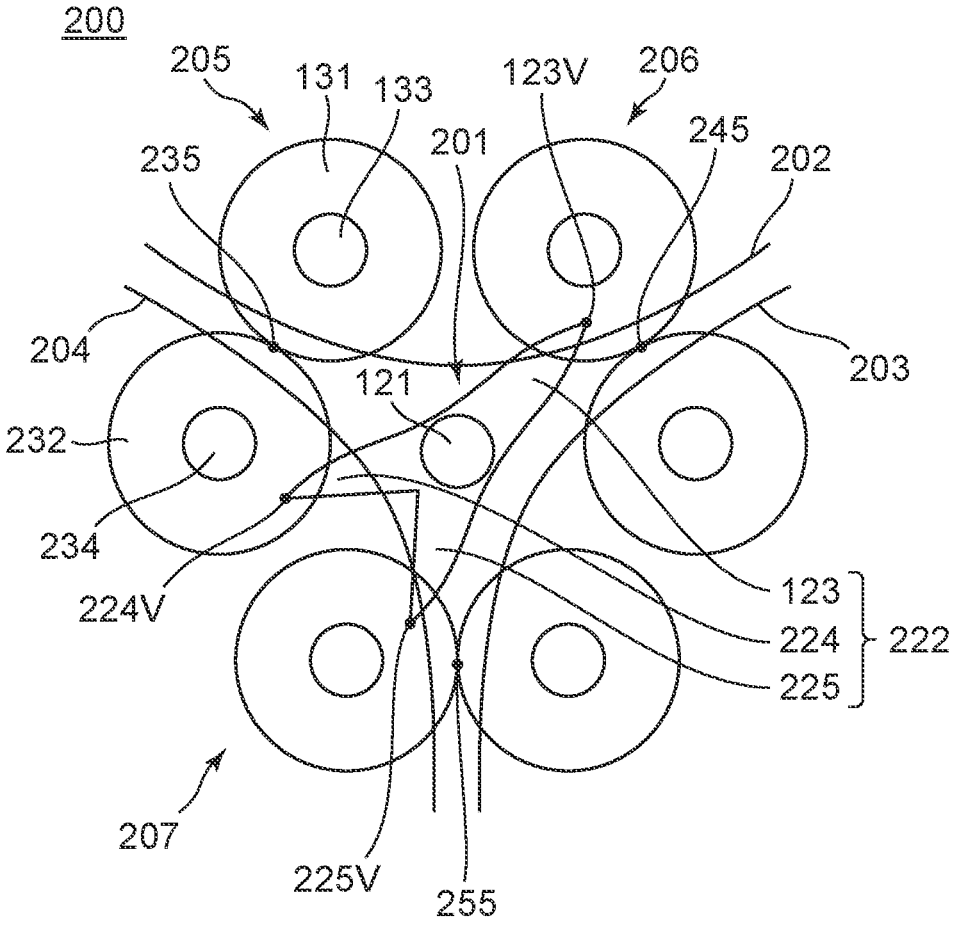
FIG. 17A is a schematic view illustrating a configuration of a general three-way switching unit.
Figure 17B:
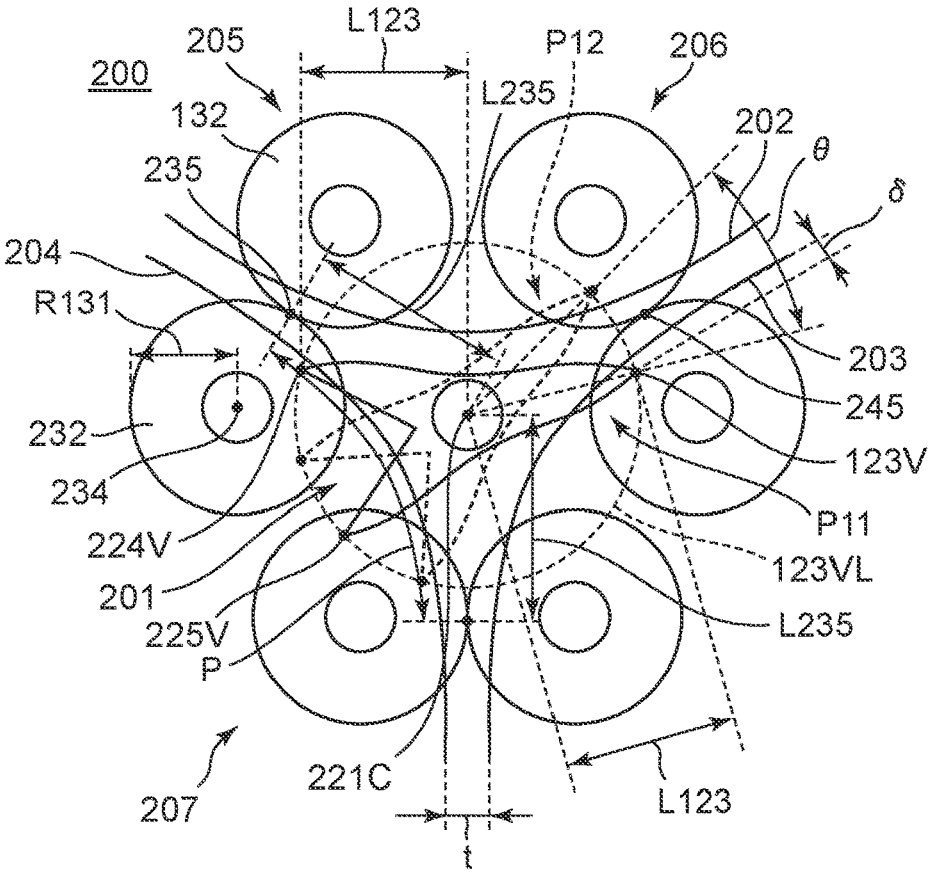
FIG. 17B is a schematic view illustrating a configuration of the general three-way switching unit.

In the switching unit 63, for the above-described reason, the center holding distance L135 and the center holding distance L145 relating to the holding point 135 and the holding point 145 can be shorter than the center holding distance L235 relating to the holding point 235 and the holding point 245 in the switching unit 200 (FIG. 17A or FIG. 17B). The center holding distance L155 relating to the holding point 155 in the switching unit 63 is longer than the center holding distance L235 relating to the holding point 255 in the switching unit 200. Thereby, the banknotes can be reliably handed off between the pair of conveyance rollers 105 or the pair of conveyance rollers 106 and the pair of conveyance rollers 107 in the switching unit 63.

In addition, the switching unit 63 is configured such that the short blade end distance L124 is shorter than the long blade end distance L123 and is shorter than the lower roller center axis distance L134. Thereby, in the switching unit 63, when the blade 101 is rotated in a range where the long blade end point 123V is located within the blade rotation range 123VA (FIG. 14), the blade 101 can be smoothly rotated without causing the short blade portion 124 to interfere with the lower roller center axis 134 and the lower roller center axis 144.

As described above, the center holding distance L155 relating to the holding point 155 is relatively long in the switching unit 63, and thereby it is possible to provide the hand-off unit 160 between the blade 101 and the pair of conveyance rollers 107 (FIG. 16A and FIG. 16B) while realizing the normal hand-off of banknotes in a state of switching to any one of the three conveyance routes. In other words, even if the pair of conveyance rollers 107 is disposed slightly away from the blade 101 across the hand-off unit 160, the switching unit 63 can normally hand off banknotes between the holding point 135 of the pair of conveyance rollers 105 and the holding point 155 of the pair of conveyance rollers 107 or the holding point 145 of the pair of conveyance rollers 106 and the holding point 155 of the pair of conveyance rollers 107.

As a result, since the banknote deposit/withdrawal device 10 does not require the pair of conveyance rollers 107 of the switching unit 63 at a side of the lower conveyance section 21 (FIG. 5), a length of the lower conveyance section 21 in the up-down direction can be relatively small, and thereby the banknote deposit/withdrawal device 10 can be downsized as a whole. In addition, since the pair of conveyance rollers 107 which is a part of the switching unit 63 can be double used as the pair of conveyance rollers to be provided in a side of the banknote storage box 22C, the banknote deposit/withdrawal device 10 can reduce the number of parts as compared with a case where these pair of conveyance rollers are separately provided.

In the general three-way switching unit 200 (FIG. 17A and FIG. 17B), although there are three conveyance routes that can be formed, there are six postures (rotation angles) of the blade 201 that form each conveyance route.

Specifically, the positions of the long blade end point 123V in the blade 201 are the upper side and the lower side of the conveyance path 75, the upper side and the lower side of the conveyance path 77, and at the front side and rear side of the conveyance path 76.

On the other hand, since the switching unit 63 defines the blade rotation range 123VA (FIG. 14), the long blade portion 123 of the blade 101 cannot be rotated below the blade center point 121C, and thereby the blade 101 that forms the conveyance route has four postures: the blade first posture P1, the blade second posture P2, the blade third posture P3, and the blade fourth posture P4. Therefore, in the switching unit 63, it is necessary to rotate the blade 101 in a range of a relatively large angle such as about 70 to 90°, between the blade second posture P2 that forms the conveyance route W23 and the blade third posture P3 that forms the conveyance route W22, and therefore it is extremely difficult to switch between the two postures at a high speed.

However, in the banknote deposit/withdrawal device 10, the switching unit 63 can perform the low-speed switching operation with respect to a plurality of the banknotes sequentially conveyed from the conveyance path 76 located in the downward side. That is, the banknote deposit/withdrawal device 10 does not need to perform an operation such that the conveyance destination is switched to the conveyance route W22 or the conveyance route W23 (FIG. 14) for each banknote. This is related to an arrangement of each module in the banknote deposit/withdrawal device 10.

In the banknote deposit/withdrawal device 10 (FIG. 6), the conveyance path 75 and the conveyance path 77 connected to the switching unit 63 are a part of the lower loop-shaped conveyance path WCL, and the classification section 14 is disposed on the lower loop-shaped conveyance path WCL. On the other hand, only the banknote storage box 22C is connected to the conveyance path 76 connected to the switching unit 63. When a plurality of banknotes conveyed in the banknote deposit/withdrawal device 10 are passed through the classification section 14, the conveyance destination of each banknote may differ from one to the next depending on an obtained classification result. However, a plurality of banknotes fed from the banknote storage box 22C would not have been classified when the banknotes reach the switching unit 63. Therefore, the switching unit 63 does not need to switch the conveyance destination of each banknote one-by-one, and each banknote may be sequentially conveyed along the same conveyance route while maintaining the conveyance path previously switched according to a process being executed, such as a withdrawal process.

In the banknote deposit/withdrawal device 10, the switching unit 63 does not need to perform the high-speed switching operation with respect to banknotes continuously conveyed from the conveyance path 76 located in the lower side. Therefore, the banknote deposit/withdrawal device 10 can realize all necessary operations such as switching of a conveyance route and handing off banknotes in various transaction processes while being limited the rotation range of the blade 101.

According to the above configuration in the banknote deposit/withdrawal device 10 of the ATM 1, in the switching unit 63 of the lower conveyance section 21, the lower roller 132 and the lower roller 142 have a larger diameters than the upper roller 131 and the upper roller 141, and the lower roller center axis distance L134 is shorter than the upper roller center axis distance L133. In addition, the short blade end distance L124 is shorter than the long blade end distance L123, and is shorter than the lower roller center axis distance L134. Accordingly, the interval between the blade 101 and the pair of conveyance rollers 107 in the switching unit 63 can be made longer than in a general configuration, and thereby the degree of freedom for design can be significantly increased.

6. Other Exemplary Embodiments

In the above-described exemplary embodiment, a case has been described in which the lower roller center axis 134 and the lower roller center axis 144 are disposed such that part of the lower roller center axis 134 and part of the lower roller center axis 144 are located inside the long blade end trajectory circle 123VC (FIG. 13). However, the present disclosure is not limited to this. For example, at least one of the lower roller center axis 134 and the lower roller center axis 144 may be disposed outside the long blade end trajectory circle 123VC. In such an embodiment, the distance between the holding point 135 along the conveyance route W22 and the holding point 155 or the distance between the holding point 145 along the conveyance route W23 and the holding point 155 is still shorter than the length of the banknote in the conveyance direction. According to some embodiments of the invention, the distance from the blade center point 121C to the short blade end point 124V or the distance from the blade center point 121C to the short blade end point 125V may be equal to the long blade end distance L123. In such embodiments, the blade 101 does not interfere with the lower roller center axis 134 when rotating the blade 101.

In above-described exemplary embodiment, the case has been described in which the radius of the lower roller 132 and the radius of the lower roller 142 are larger than the radius of the upper roller 131 and the radius of the upper roller 141, in both of the pair of conveyance rollers 105 and the pair of conveyance rollers 106 (FIG. 13). However, the present disclosure is not limited to this. For example, in one embodiment, the radius of the lower roller 132 or the radius of the lower roller 142 may be equal to the radius of the upper roller 131 or the radius of the upper roller 141.

In above-described exemplary embodiment, the case has been described in which the upper roller 131 rotates by being transmitted the driving force from the motor (not illustrated in the drawings) and the lower roller 132 is driven by being pressed against the upper roller 131, in the pair of conveyance rollers 105. However, the present disclosure is not limited to this. For example, in one embodiment the lower roller 132 may be rotated by being transmitted the driving force from the motor (not illustrated in the drawings) and the upper roller 131 may be driven by pressing against the lower roller 132.

In above-described exemplary embodiment, the case has been described in which the upper comb-tooth portion 161 is provided at a side of the upper conveyance guide 103U and the lower comb-tooth portion 162 is provided at a side of the lower conveyance guide 103L in the hand-off unit 160 of the switching unit 63, thereby guiding banknotes in both direction by interlocking the upper comb-tooth portion 161 and the lower comb-tooth portion 162. However, the present disclosure is not limited to this. For example, the conveyance guide 103 may be configured such that a lower end of the upper conveyance guide 103U is formed in a straight line in the left-right direction and in a thin plate shape in the front-rear direction, and the lower end of the upper conveyance guide 103U may be overlapped behind an upper end of the lower conveyance guide 103L (that is, inside the conveyance path 76). Further, the conveyance guide 104 may be configured symmetrically with the conveyance guide 103. In this case, the banknote can be guided only downward, and the configuration can be simplified as compared with the hand-off unit 160.

In the above-described exemplary embodiment, the case has been described in which the hand-off unit 160 is disposed between the blade 101 of the switching unit 63 and the pair of conveyance roller 107 (FIG. 16A and FIG. 16B). However, the present disclosure is not limited to this. For example, other various components such as a sensor for detecting a banknote may be disposed between the blade 101 and the pair of conveyance rollers 107. Alternatively, for example, if it is desired to reduce the interval between the pair of conveyance rollers 107 and another pair of conveyance rollers (not illustrated in the drawings) disposed below the pair of conveyance rollers 107, the pair of conveyance rollers 107 may be disposed as far as possible from the blade 101 without disposing other components between on the pair of conveyance rollers 107 and the blade 101.

Figure 18:
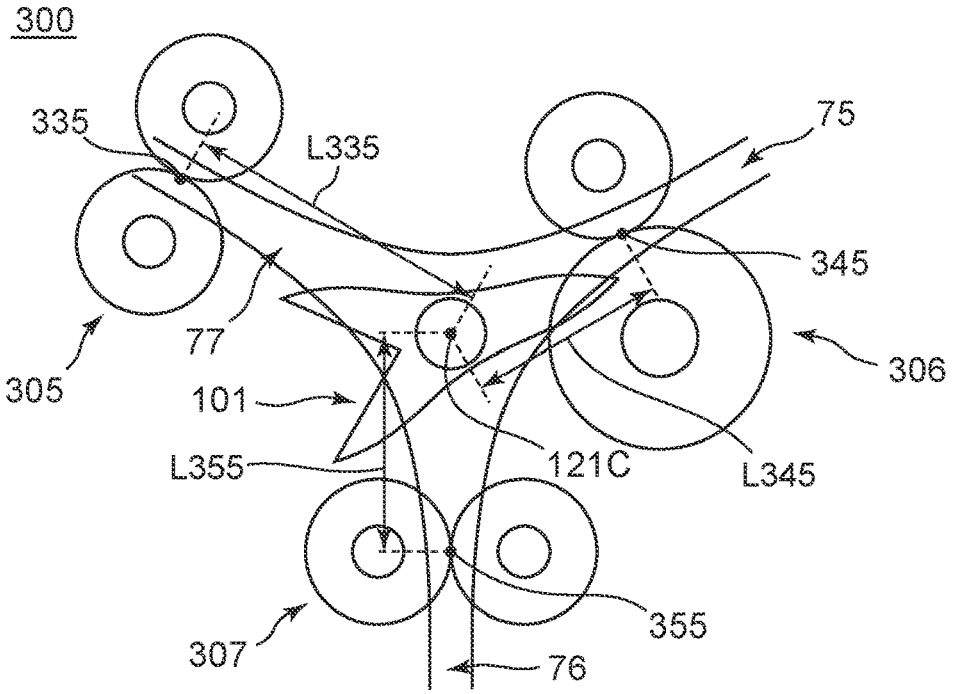
FIG. 18 is a schematic view illustrating a configuration of a switching unit according to another embodiment.

In the above-described exemplary embodiment, the case has been described in which the center holding distance L155 relating to the pair of conveyance rollers 107 in the switching unit 63 is larger (longer) than the center holding distance L135 and the center holding distance L145 relating to the pair of conveyance rollers 105 and the pair of conveyance rollers 106. However, the present disclosure is not limited to this. For example, as a switching unit 300 illustrated in FIG. 18, a pair of conveyance rollers 305, a pair of conveyance rollers 306 and a pair of conveyance rollers 307 may be disposed such that a center holding distance L335 is longer than a center holding distance L345 and a center holding distance L355.

In the above-described exemplary embodiment, the case has been described in which the present disclosure is applied to the three-ways switching unit 63 disposed above the banknote storage box 22C in the lower conveyance section 21. However, the present disclosure is not limited to this. For example, the present disclosure may be applied to other various switching units such as the temporary holding switching unit 52 or the segregation switching unit 53 in the upper rear conveyance section 15 (FIG. 4A and FIG. 4B).

In the above-described exemplary embodiment, the case has been described in which the present disclosure is applied to the banknote deposit/withdrawal device 10 of the ATM 1 that performs the transaction process relating to the banknote as the medium with customers. However, the present disclosure is not limited to this. For example, the present disclosure may be applied to various devices that handle various sheet-shape media such as cash vouchers, securities, entrance tickets, passenger tickets, or the like.

The present disclosure is not limited to the exemplary embodiment and the other exemplary embodiments described above. Namely, the range of application of the present disclosure encompasses exemplary embodiments appropriately combining elements of some or all of the exemplary embodiment and the other exemplary embodiments described above, and embodiments deriving from elements thereof.

In the above-described exemplary embodiment, the case has been described in which the banknote deposit/withdrawal device 10 as the medium processing device is configured by the conveyance guides 102, 103 and 104 as a conveyance guide, the blade 101 as a blade, and the pair of conveyance rollers 105, 106 and 107 as a first, second, third pair of conveyance rollers. However, the present disclosure is not limited to this. The medium processing device may be configured by a conveyance guide, a blade, and a first, second, a third pair of conveyance rollers of various other configurations.

While embodiments have been described above with respect to elements being arranged in a particular front-rear, left-right, or upward-downward arrangement for purposes of clarity by referring to the drawings, embodiments of the invention are not limited to the recited attitudes of the elements. For example, for an element described as extending in a front-rear direction, it is understood that embodiments also encompass a rotation of the element, as well as any surrounding elements, to be arranged in a left-right direction or an upward-downward direction, according to design considerations. For example, rollers that are shown in the drawings as being arranged to extend in a left-right direction, so that a medium is conveyed in an upward-downward and/or front-rear direction, could be instead arranged to extend in the front-rear direction and further guides could be provided in a machine or apparatus to guide the medium to an appropriate destination.

INDUSTRIAL APPLICABILITY

The present invention may be employed in, for example, a banknote deposit/withdrawal device incorporated in an automatic teller machine that performs a deposit transaction or a withdrawal transaction regarding banknotes with a user.

The disclosure of Japanese Patent Application No. 2018-011921 filed on Jan. 26, 2018, the entire contents which are incorporated herein by reference.

The invention claimed is:

1. A medium processing device, comprising:

a conveyance guide that forms first, second and third conveyance paths that intersect, and that guides a medium along each conveyance path;

a blade configured to be rotatable around a blade center point, and that switches a conveyance route of the medium by connecting any two of the three conveyance paths with each other;

a first pair of conveyance rollers in the first conveyance path, the first pair of conveyance rollers including a first roller and a second roller facing the first roller across the first conveyance path;

a second pair of conveyance rollers in the second conveyance path, the second pair of conveyance rollers including a third roller and a fourth roller facing the third roller across the second conveyance path; and a third pair of conveyance rollers in the third conveyance path, the third pair of conveyance rollers including a fifth roller and a sixth roller facing the fifth roller across the third conveyance path, wherein the first, second, and third pairs of conveyance rollers are rotatable and are configured to hand off the medium between two conveyance paths connected by the blade, wherein the second roller is closer than the first roller to the third pair of conveyance rollers, wherein the fourth roller is closer than the third roller to the third pair of conveyance rollers, wherein a radius of the second roller is larger than a radius of the first roller, wherein a first holding point is a point between the first roller and the second roller where the first pair of conveyance rollers holds the medium, wherein a second holding point is a point between the third roller and the fourth roller where the second pair of conveyance rollers holds the medium, wherein a third holding point is a point between the fifth roller and the sixth roller where the third pair of conveyance rollers holds the medium, wherein a distance from the blade center point to the first holding point defines a first center holding distance, wherein a distance from the blade center point to the second holding point defines a second center holding distance, wherein a distance from the blade center point to the third holding point defines a third center holding distance, and wherein the first center holding distance is different from one or both of the second center holding distance and the third center holding distance.

2. The medium processing device of claim 1, wherein a radius of the fourth roller is larger than a radius of the third roller, and the third center holding distance is larger than each of the first center holding distance and the second center holding distance.

3. The medium processing device of claim 2, wherein a distance from the blade center point to a circumferential side face of a second roller center axis penetrating through a center of rotation of the second roller defines a second roller center axis distance, a distance from the blade center point to a circumferential side face of a first roller center axis penetrating through a center of rotation of the first roller is a first roller center axis distance, the second roller center axis distance is less than the first roller center axis distance, a distance from the blade center point to a circumferential side face of a fourth roller center axis penetrating through a center of rotation of the fourth roller is a fourth roller center axis distance, a distance from the blade center point to circumferential side face of a third roller center axis penetrating through a center of rotation of the third roller is a third roller center axis distance, and the fourth roller center axis distance is smaller than the third roller center axis distance.

4. The medium processing device of claim 3, wherein the blade includes a long blade portion protruding from the blade center point toward one side and one or more short blade portions protruding toward an opposite side of the long blade portion with respect to the blade center point, a distance from the blade center point to a long blade end point in the long blade portion that is farthest from the blade center point is a long blade end distance, the second roller center axis distance is smaller than the long blade end distance, the first roller center axis distance is larger than the long blade end distance, the fourth roller center axis distance is smaller than the long blade end distance, and the third roller center axis distance is larger than the long blade end distance.

5. The medium processing device of claim 4, wherein a distance from the blade center point to a short blade end point in the short blade portion that is farthest from the blade center point is a short blade end distance, the first roller center axis distance and the second roller center axis distance are each larger than the short blade end distance and the third roller center axis distance and the fourth roller center axis distance are each larger than the short blade end distance.

6. The medium processing device of claim 2, wherein the conveyance guide includes a first conveyance guide and a second conveyance guide, the first conveyance guide being disposed in vicinity of the first and second pairs of conveyance rollers and between the blade center point and the third pair of conveyance roller, the second conveyance guide being disposed in vicinity of the third pair of conveyance rollers and between the blade center point and the third pair of conveyance roller, the first conveyance guide and the second conveyance guide configured to be moved between a connected stated and a separated state, and the conveyance guide and the second conveyance guide configured to guide the medium along the third conveyance path in the connected state.

7. The medium processing device of claim 6, wherein the first conveyance guide is formed with a comb-tooth portion along a width direction orthogonal to a conveyance direction of the medium, the second conveyance guide is provided with a second comb-tooth portion along a width direction orthogonal to a conveyance direction of the medium, and the first comb-tooth portion and the second comb-tooth portion are meshed with each other in connected state.

8. The medium processing device of claim 2, wherein the blade has a long blade portion protruding from the blade center point toward one side, and the blade is configured to be rotatable in a range such that a long blade end point in the long blade portion of the blade that is farthest from the blade center point is rotatable through the first and second conveyance paths and is not rotatable through a side of the third conveyance path.

9. An automatic transaction device, comprising:

deposit port that receives a medium from a user;

a first storage box that stores the medium that the deposit port received;

a second storage box that stores the medium that the deposit port received;

a conveyance guide that forms first, second and third conveyance paths that intersect, and that guides a medium-to-be-transacted along each conveyance path;

a blade configured to be rotatable around a blade center point in accordance with a transaction, and that switches a conveyance route of the medium by connecting any two of the three conveyance paths with each other;

a first pair of conveyance rollers in the first conveyance path, the first pair of conveyance rollers including a first roller and a second roller facing the first roller across the first conveyance path;

a second pair of conveyance rollers in the second conveyance path, the second pair of conveyance rollers including a third roller and a fourth roller facing the third roller across the second conveyance path; and a third pair of conveyance rollers in the third conveyance path, the third pair of conveyance rollers including a fifth roller and a sixth roller facing the fifth roller across the third conveyance path, wherein the first, second, and third pairs of rollers are rotatable and are configured to hand off the medium between two conveyance paths connected by the blade, wherein the first conveyance path is a path connecting between the deposit port and the blade, wherein the second conveyance path is a path connecting between the blade and the first storage box, wherein the third conveyance path is a path connecting between the blade and the second storage box, wherein the second roller is closer than the first roller to the third pair of conveyance rollers, wherein the fourth roller is closer than the third roller to the third pair of conveyance rollers, wherein a radius of the second roller is larger than a radius of the first roller, wherein a first holding point is a point between the first roller and the second roller where the first pair of conveyance rollers holds the medium, wherein a second holding point is a point between the third roller and the fourth roller where the second pair of conveyance rollers holds the medium, wherein a third holding point is a point between the fifth roller and the sixth roller where the third pair of conveyance rollers holds the medium, wherein a distance from the blade center point to the first holding point defines a first center holding distance, wherein a distance from the blade center point to the second holding point defines a first center holding distance, wherein a distance from the blade center point to the third holding point defines a first center holding distance, and wherein the first center holding distance is different from one or both of the second center holding distance and the third center holding distance.

* * * * *